US007416020B2

(12) United States Patent
Duhn et al.

(10) Patent No.: US 7,416,020 B2
(45) Date of Patent: Aug. 26, 2008

(54) WELLHEAD ISOLATION TOOL, WELLHEAD ASSEMBLY INCORPORATING THE SAME, AND METHOD OF FRACTURING A WELL

(75) Inventors: Rex E. Duhn, The Woodlands, TX (US); Robert K. Meek, Bakersfield, CA (US)

(73) Assignee: Duhn Oil Tool, Inc., Bakersfield, CA (US)

( * ) Notice: Subject to any disclaimer, the term of this patent is extended or adjusted under 35 U.S.C. 154(b) by 0 days.

(21) Appl. No.: 11/891,431

(22) Filed: Aug. 9, 2007

(65) Prior Publication Data

US 2007/0272402 A1 Nov. 29, 2007

Related U.S. Application Data

(60) Division of application No. 11/272,289, filed on Nov. 9, 2005, which is a continuation of application No. 10/947,778, filed on Sep. 23, 2004, and a continuation-in-part of application No. 10/462,941, filed on Jun. 17, 2003, now abandoned, which is a continuation-in-part of application No. 10/369,070, filed on Feb. 19, 2003, now Pat. No. 6,920,925.

(60) Provisional application No. 60/506,461, filed on Sep. 26, 2003, provisional application No. 60/357,939, filed on Feb. 19, 2002.

(51) Int. Cl.
*E21B 33/03* (2006.01)

(52) U.S. Cl. ..... 166/75.13; 166/75.14; 166/96.1; 285/123.1

(58) Field of Classification Search ..... 166/95.1, 166/75.13, 76.1, 96.1, 75.14, 368; 285/123.1
See application file for complete search history.

(56) References Cited

U.S. PATENT DOCUMENTS

| | | | | |
|---|---|---|---|---|
| 2,074,923 | A | 3/1937 | Kitchel et al. | |
| 2,157,964 | A | 5/1939 | Mueller | |
| 2,350,867 | A * | 6/1944 | Bean et al. | 285/96 |
| 3,166,125 | A * | 1/1965 | Hubby | 166/67 |
| 3,186,488 | A | 6/1965 | Johnson et al. | |
| 3,188,118 | A | 6/1965 | Jones | |
| 3,209,829 | A * | 10/1965 | Haeber | 166/348 |

(Continued)

FOREIGN PATENT DOCUMENTS

CA 2 428 613 11/2004

OTHER PUBLICATIONS

ARP/IRP's on-line, 4 pages.

(Continued)

*Primary Examiner*—Kenneth Thompson
(74) *Attorney, Agent, or Firm*—Christie, Parker & Hale, LLP

(57) ABSTRACT

A wellhead assembly is provided including a casing and a tubular member mounted over the casing. A flange extends from the tubular member. A generally elongated annular member is provided in the tubular member. The generally elongated annular member has a first end portion above the tubular member and second end portion below the first end portion. A hanger may be suspended within the tubular member. In such case, a seal may be formed between the elongate annular member and the hanger.

31 Claims, 12 Drawing Sheets

U.S. PATENT DOCUMENTS

| | | | |
|---|---|---|---|
| 3,830,304 | A | 8/1974 | Cummins |
| 3,848,421 | A | 11/1974 | O'Brien et al. |
| 3,976,093 | A | 8/1976 | Cornelius |
| 4,111,261 | A | 9/1978 | Oliver |
| 4,116,044 | A | 9/1978 | Garrett |
| 4,241,786 | A | 12/1980 | Bullen |
| 4,552,213 | A | 11/1985 | Boyd et al. |
| 4,657,075 | A | 4/1987 | McLeod |
| 4,690,221 | A | 9/1987 | Ritter, Jr. |
| 4,697,828 | A | 10/1987 | Chou |
| 4,867,243 | A | 9/1989 | Garner et al. |
| 4,991,650 | A | 2/1991 | McLeod |
| 4,993,489 | A | 2/1991 | McLeod |
| 5,060,723 | A | 10/1991 | Sutherland et al. |
| 5,103,900 | A | 4/1992 | McLeod et al. |
| 5,113,936 | A | 5/1992 | Sutherland |
| 5,143,158 | A | 9/1992 | Watkins et al. |
| 5,236,037 | A | 8/1993 | Watkins |
| 5,285,852 | A | 2/1994 | McLeod |
| 5,289,882 | A | 3/1994 | Moore |
| 5,372,202 | A | 12/1994 | Dallas |
| 5,490,565 | A | 2/1996 | Baker |
| 5,540,282 | A | 7/1996 | Dallas |
| 5,605,194 | A | 2/1997 | Smith |
| 5,735,344 | A | 4/1998 | Duncan |
| 5,785,121 | A | 7/1998 | Dallas |
| 5,819,851 | A | 10/1998 | Dallas |
| 5,927,403 | A | 7/1999 | Dallas |
| 5,975,211 | A | 11/1999 | Harris |
| 6,039,120 | A | 3/2000 | Wilkins et al. |
| 6,092,596 | A | 7/2000 | Van Bilderbeek |
| 6,179,053 | B1 | 1/2001 | Dallas |
| 6,196,323 | B1 | 3/2001 | Møksvold |
| 6,199,914 | B1 | 3/2001 | Duhn |
| 6,220,363 | B1 | 4/2001 | Dallas |
| 6,260,624 | B1 | 7/2001 | Pallini, Jr. et al. |
| 6,289,993 | B1 | 9/2001 | Dallas |
| 6,345,668 | B1 | 2/2002 | Reilly |
| 6,360,822 | B1 | 3/2002 | Robertson |
| 6,364,024 | B1 | 4/2002 | Dallas |
| 6,516,861 | B2 | 2/2003 | Allen |
| 6,688,386 | B2 | 2/2004 | Cornelssen et al. |
| 6,712,147 | B2 | 3/2004 | Dallas |
| 7,032,677 | B2 | 4/2006 | McGuire et al. |
| 7,066,269 | B2 | 6/2006 | Dallas et al. |
| 7,159,652 | B2 | 1/2007 | McGuire et al. |
| 7,237,615 | B2 | 7/2007 | Dallas et al. |
| 2002/0062964 | A1 | 5/2002 | Allen |
| 2002/0100592 | A1 | 8/2002 | Garrett et al. |
| 2002/0117298 | A1 | 8/2002 | Wong et al. |
| 2002/0125005 | A1 | 9/2002 | Eslinger et al. |
| 2002/0185276 | A1 | 12/2002 | Muller et al. |
| 2002/0195248 | A1 | 12/2002 | Ingram et al. |
| 2003/0000693 | A1 | 1/2003 | Couren et al. |
| 2003/0019628 | A1 | 1/2003 | Ravensbergen et al. |
| 2003/0024709 | A1 | 2/2003 | Cuppen |
| 2006/0185841 | A1 | 8/2006 | Swagerty et al. |
| 2006/0196677 | A1 | 9/2006 | McGuire et al. |

OTHER PUBLICATIONS

Cameron, Full Bore Time Saving Wellhead Installation Procedure, Surface Wellhead Proposals Publication RP-830, Jun. 19, 2003, Rev. 1,pp. 1-37.

Cooper Oil Tool, W-K-M Wellhead Equipment Catalog 86, article entitled "W-K-M Metal-to-Metal Sealing Tubing Hangers", © 1994 Cooper Industries, Houston, Texas.

Guardian, Casing & Tree Savers, 2000, 3 pages.

* cited by examiner

WELLHEAD ISOLATION TOOL, WELLHEAD ASSEMBLY INCORPORATING THE SAME, AND METHOD OF FRACTURING A WELL

CROSS-REFERENCE TO RELATED APPLICATION(S)

This application is a divisional of U.S. application Ser. No. 11/272,289, filed on Nov. 9, 2005, which is a continuation of U.S. application Ser. No. 10/947,778, filed on Sep. 23, 2004, which claims priority and is based upon U.S. Provisional Application No. 60/506,461, filed on Sep. 26, 2003, and is a continuation-in-part application of U.S. patent application Ser. No. 10/462,941 filed on Jun. 17, 2003 now abandoned, which is a continuation-in-part application of U.S. patent application Ser. No. 10/369,070, filed on Feb. 19, 2003, and issued as U.S. Pat. No. 6,920,925, which claims priority and is based upon Provisional Application No. 60/357,939, filed on Feb. 19, 2002, the contents of all of which are fully incorporated herein by reference.

BACKGROUND OF THE INVENTION

The present invention relates to wellhead equipment, and to a wellhead tool for isolating wellhead equipment from the extreme pressures and abrasive materials used in oil and gas well stimulation and to a method of using the same.

Oil and gas wells often require remedial actions in order to enhance production of hydrocarbons from the producing zones of subterranean formations. These actions include a process called fracturing whereby fluids are pumped into the formation at high pressures in order to break up the product bearing zone. This is done to increase the flow of the product to the well bore where it is collected and retrieved. Abrasive materials, such as sand or bauxite, called propates are also pumped into the fractures created in the formation to prop the fractures open allowing an increase in product flow. These procedures are a normal part of placing a new well into production and are common in older wells as the formation near the well bore begins to dry up. These procedures may also be required in older wells that tend to collapse in the subterranean zone as product is depleted in order to maintain open flow paths to the well bore.

The surface wellhead equipment is usually rated to handle the anticipated pressures that might be produced by the well when it first enters production. However, the pressures encountered during the fracturing process are normally considerably higher than those of the producing well. For the sake of economy, it is desirable to have equipment on the well rated for the normal pressures to be encountered. In order to safely fracture the well then, a means must be provided whereby the elevated pressures are safely contained and means must also be provided to control the well pressures. It is common in the industry to accomplish these requirements by using a 'stinger' that is rated for the pressures to be encountered. The 'stinger' reaches through the wellhead and into the tubing or casing through which the fracturing process is to be communicated to the producing subterranean zone. The 'stinger' also commonly extends through a blow out preventer (BOP) that has been placed on the top of the wellhead to control well pressures. Therefore, the 'stinger', by its nature, has a reduced bore which typically restricts the flow into the well during the fracturing process. Additionally, the placement of the BOP on the wellhead requires substantial ancillary equipment due to its size and weight.

It would, therefore, be desirable to have a product which does not restrict the flow into a well during fracturing and a method of fracturing whereby fracturing may be safely performed, the wellhead equipment can be protected from excessive pressures and abrasives and the unwieldy BOP equipment can be eliminated without requiring the expense of upgrading the pressure rating of the wellhead equipment. It would also be desirable to maintain an upper profile within the wellhead that would allow the use of standard equipment for the suspension of production tubulars upon final completion of the well.

SUMMARY OF THE INVENTION

In one exemplary embodiment, a wellhead assembly is provided including a first tubular member, a hanger mounted within the first tubular member and an annular member coupled to the outer surface of the hanger. The assembly also includes a second tubular member mounted to the annular member and surrounding a portion of the hanger. The assembly may also include studs extending from the annular member. The second tubular member may include a flange that is penetrated by the studs. In an exemplary embodiment assembly a seal if formed between the hanger and the second tubular member. In another exemplary embodiment, a wear sleeve may be fitted within a central opening extending through the hanger. The assembly may also have another flange spaced apart from the flange penetrated by the studs providing a surface for mounting wellhead equipment. In an exemplary embodiment the first tubular member is a casing head, the annular member is a collar nut and the second annular member is isolation tool.

In another exemplary embodiment a method for fracturing a well is provided requiring coupling a tubing mandrel hanger to a casing, the hanger having a central bore, threading an annular nut having studs extending there from on threads formed on the outer surface of the hanger, and mounting a tubular member having a flange over the hanger such that the studs penetrate openings formed through the flange. The method also requires coupling nuts to the studs penetrating the openings formed though the flange and applying fluids though the bore formed though the hanger for fracturing the well. The method may also include forming a seal between the tubular member and the hanger. Moreover the method may require installing a wear sleeve within the bore.

In another exemplary embodiment, the method further requires removing the tubular member from the hanger, removing the annular member from the hanger, removing the wear sleeve if installed, and threading a second tubular member on said threads on the outer surface of the hanger. The method may also require forming a seal between the second tubular member and the hanger. The second tubular member may be a tubing head.

In another exemplary embodiment, a method for fracturing a well is provided requiring coupling a tubing mandrel hanger to a casing, the hanger having a central bore, coupling an annular nut on a portion of the outer surface of the hanger, mounting a tubular member having a flange over the hanger and on the flange, and applying fluids though the bore formed though the hanger for fracturing the well. The method may also include forming a seal between the tubular member and the hanger.

Furthermore, the method may require removing the tubular member from the hanger, removing the annular member from the hanger, and mounting a second tubular member on said portion of the outer surface of the hanger. The method may also include forming a seal between the second tubular member and the hanger.

DESCRIPTION OF EXEMPLARY EMBODIMENTS OF THE INVENTION

Figure 1:
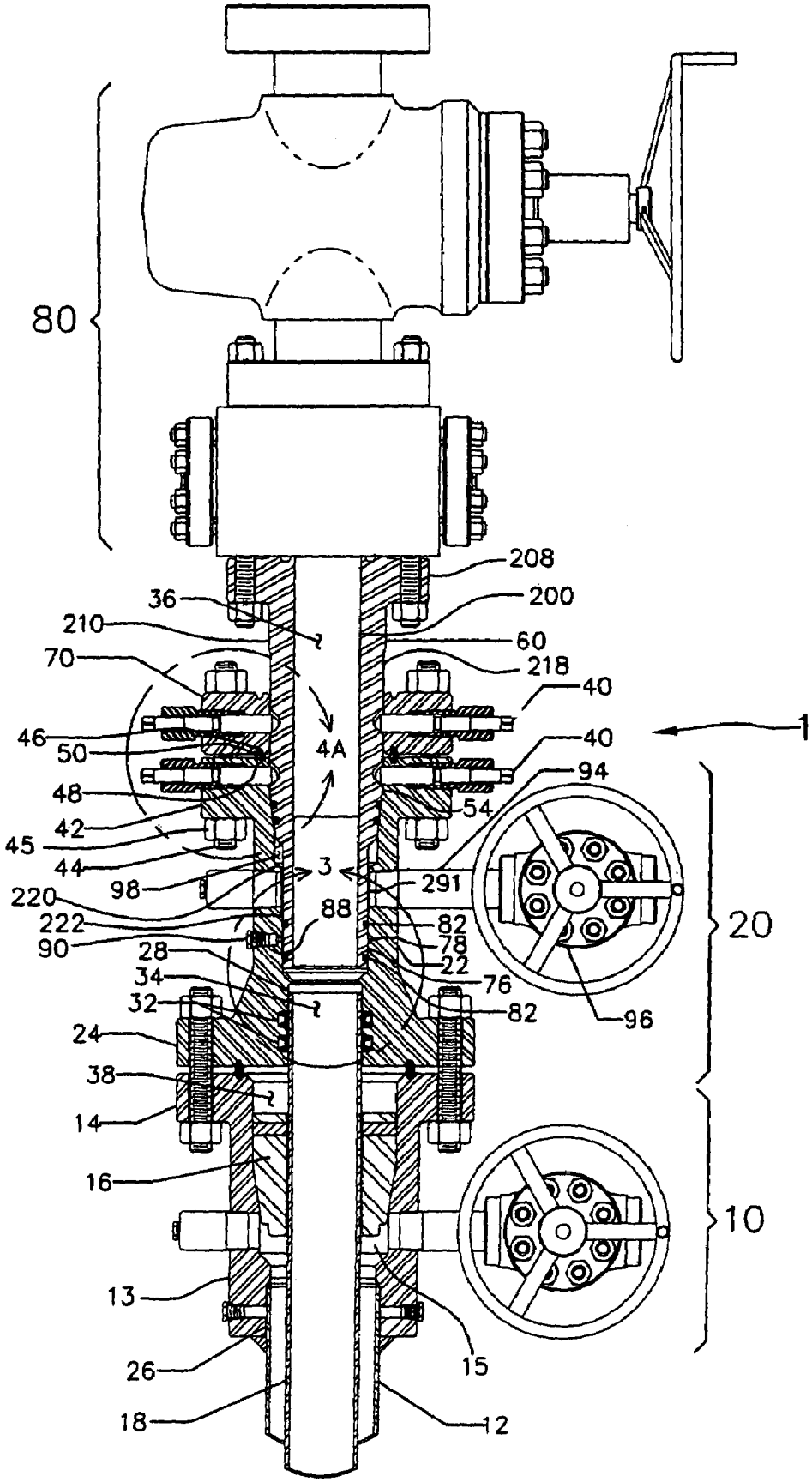
FIG. 1 is a partial cross-sectional view of a typical wellhead assembly with an exemplary embodiment wellhead isolation tool of the present invention and a fracturing tree assembly.

Referring now to the drawings and, particularly, to FIG. 1, a representation of an exemplary embodiment wellhead assembly 1 of the present invention is illustrated. The exemplary embodiment wellhead assembly 1 includes a lower housing assembly 10 also referred to herein as a casing head assembly; an upper assembly 80 also referred to herein as a fracturing tree; an intermediate body member assembly 20 also referred to herein as a tubing head assembly; and a wellhead isolation tool or member 60, which is an elongate annular member, also referred to herein as a frac mandrel. It will be recognized by those skilled in the art that there may be differing configurations of wellhead assembly 1. The casing head assembly includes a casing head 13 defining a well bore 15. The lower end 26 of casing head 13 is connected and sealed to surface casing 12 either by a welded connection as shown or by other means such as a threaded connection (not shown).

It should be noted that the terms "upper", "lower," "upward," and "downward" as used herein are relative terms for designating the relative position of elements. In other words, an assembly of the present invention may be formed upside down such that the "lower" elements are located higher than the "upper" elements.

The tubing head assembly 20 includes a body member referred to herein as the "tubing head" 22. The upper end 14 of casing head 13 cooperates with a lower end 24 of body member 22 whether by a flanged connection as shown or by other means. A production casing 18 is suspended within the well bore 15 by hanger 16. The upper end of production casing 18 extends into the body member and cooperates with the lower bore preparation 28 of body member 22. The juncture of production casing 18 and lower bore preparation 28 is sealed by seals 32. The seals 32 which may be standard or specially molded seals. In an exemplary embodiment, the seals are self energizing seals such as for example O-ring, T-seal or S-seal types of seals. Self-energizing seals do not need excessive mechanical forces for forming a seal.

Figure 3:
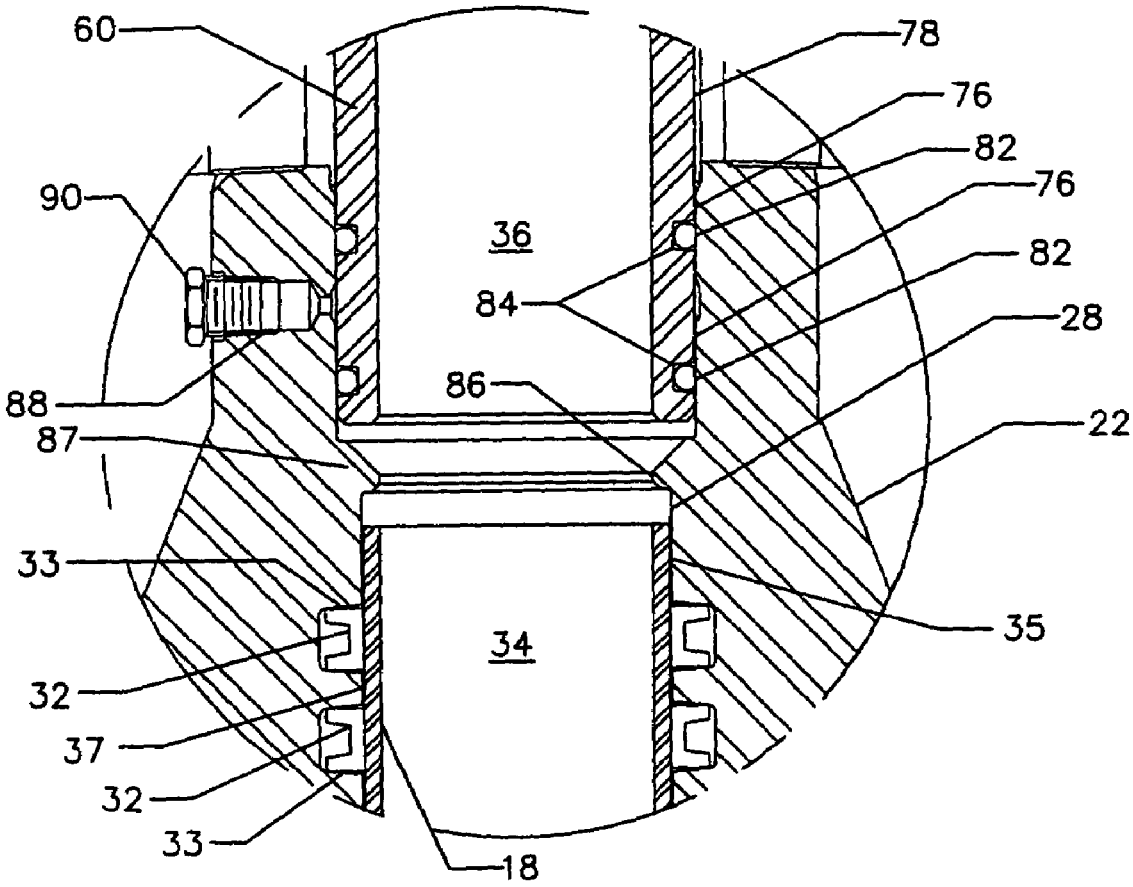
FIG. 3 is an enlarged cross-sectional view encircled by arrow 3-3 in FIG. 1.

Grooves 33 may be formed on the inner surface 35 of the body member 22 to accommodate the seals 32, as shown in FIG. 3, so that the seals seal against an outer surface 37 of the production casing 18 and the grooves 33. In this regard, the seals 32 prevent the communication of pressure contained within the production casing inner bore 34 to the cavity 38 defined in the upper portion of the well bore 15 of the casing head 13. In an alternative exemplary embodiment not shown, grooves may be formed on the outer surface 37 of the production casing 18 to accommodate the seals 32. With this embodiment, the seals seal against the inner surface 35 of the body member. In further alternate exemplary embodiments, other seals or methods of sealing may be used to prevent the communication of pressure contained within the production casing inner bore 34 to cavity 38 defined in the upper portion of the well bore 15 of the casing head 13.

It will be recognized by those skilled in the art that the production casing 18 may also be threadedly suspended within the casing head 13 by what is known in the art as an extended neck mandrel hanger (not shown) whereby the extended neck of said mandrel hanger cooperates with the lower cylindrical bore preparation 28 of body member 22 in same manner as the upper end of production casing 18 and whose juncture with lower cylindrical bore preparation 28 of body member 22 is sealed in the same manner as previously described.

In the exemplary embodiment shown in FIG. 1, the body member 22 includes an upper flange 42. A secondary flange 70 is installed on the upper flange 42 of body member utilizing a plurality of studs 44 and nuts 45. A spacer 50 cooperates with a groove 46 in secondary flange 70 and a groove 48 in the upper flange 42 of body member 22 in order to maintain concentricity between secondary flange 70 and upper flange 42.

Figure 4A:
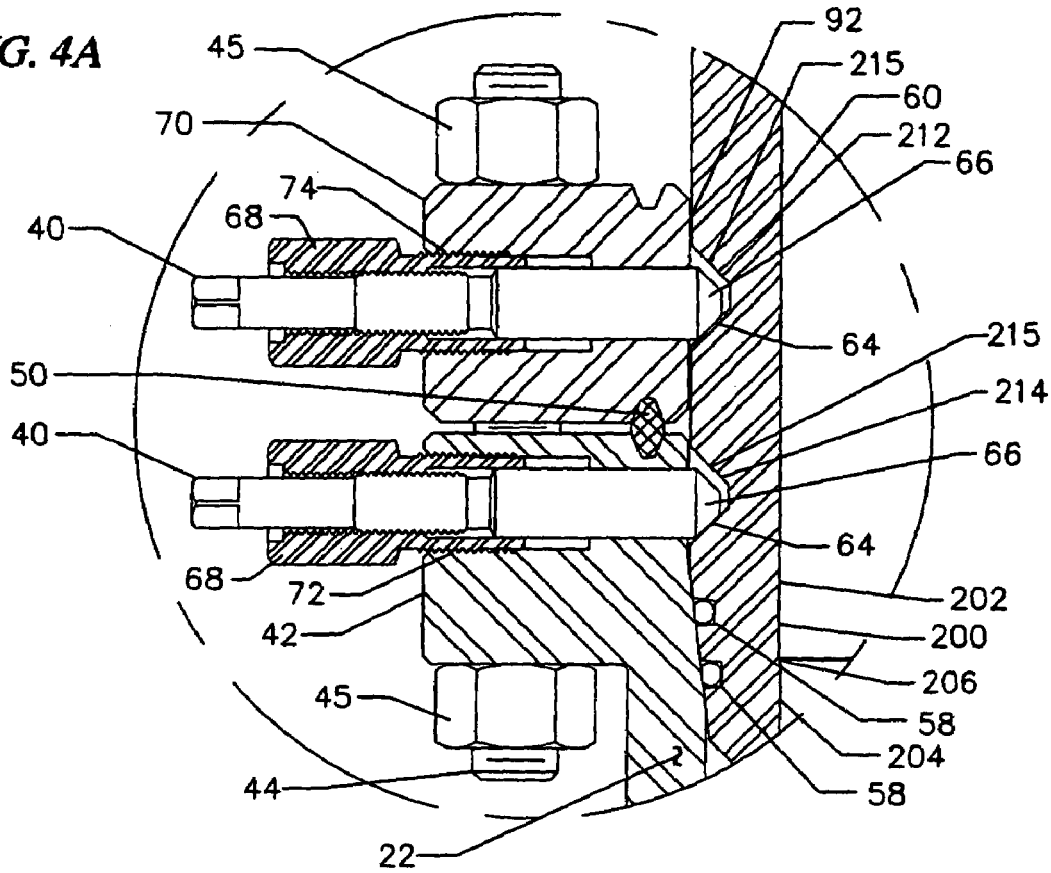
FIG. 4A is an enlarged cross-sectional view encircled by arrow 4A-4A in FIG. 1.
Figure 4B:
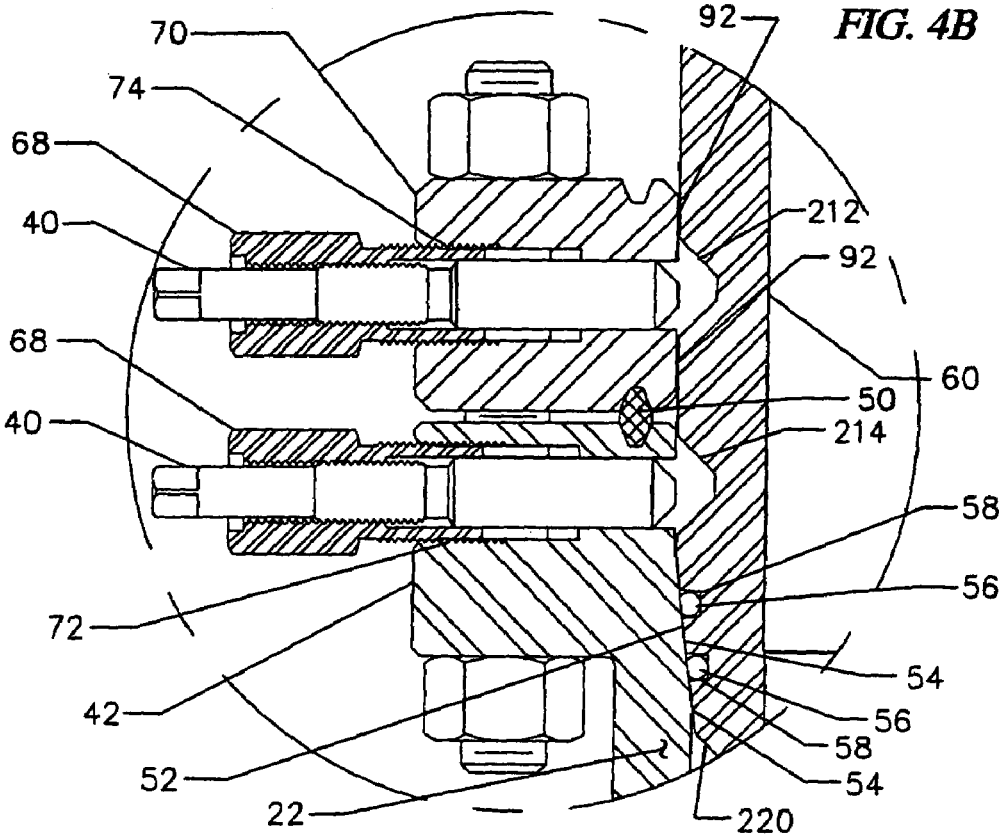
FIG. 4B is the same view as FIG. 4A with the cooperating lock screws shown in a retracted position.

Now referring to FIGS. 4A and 4B, lock screws 40 having frustum conical ends 66 threadedly cooperate with retainer nuts 68 which, in turn, threadedly cooperate with radial threaded ports 72 in upper flange 42 of body member 22 and radial threaded ports 74 in secondary flange 70. The lock screws 40 may be threadedly retracted to allow unrestricted access through bore 92 defined through the secondary flange 70 as for example shown in FIG. 4B.

With the lock screw retracted, an exemplary embodiment wellhead isolation tool 60 is installed through cylindrical bore 92 in secondary flange 70 and into the body member 22. The exemplary embodiment wellhead isolation tool shown in FIG. 1 is a generally elongated annular member having an inner surface 200 having a first section 202 having a first diameter and a second section 204 extending below the first section and having diameter smaller than that of the first section (FIG. 4A). Consequently, a shoulder 206 is defined between the two sections as for example shown in FIG. 4A.

A radial flange 208 extends from an upper end of the wellhead isolation tool and provides an interface for connecting the upper assembly or fracturing tree 80 as shown in FIG. 1. A first annular groove 212 is formed over a second annular groove 214 on an outer surface 210 of the wellhead isolation tool, as for example shown in FIGS. 4A and 4B. In cross-section the grooves are frustum-conical, i.e., they have an upper tapering surface 215 and a lower tapering surface 64 as shown in FIG. 4B. In an alternate embodiments, instead of the grooves 212, 214, a first set of depressions (not shown) is formed over as second set of depressions (not shown) on the outer surface of the wellhead isolation tool. Each set of depressions is radially arranged around the outer surface of the wellhead isolation tool. These depressions also have a frustum-conical cross-sectional shape.

The outer surface 210 of the well head isolation tool has an upper tapering portion 54 tapering from a larger diameter upper portion 218 to a smaller diameter lower portion 222. A lower tapering portion 220 extends below the upper tapering portion 54, tapering the outer surface of the wellhead isolation tool to a smaller diameter lower portion 222.

When the wellhead isolation tool is fitted into the body member through the secondary flange 70, the upper outer surface tapering portion 54 of the wellhead isolation tool mates with a complementary tapering inner surface portion 52 of the body member 22 as shown in FIG. 4B. A seal is provided between the wellhead isolation tool and the body member 22. The seal may be provided using seals 56, as for example self energizing seals such as for example O-ring, T-seal and S-seal type seals fitted in grooves 58 formed on the upper tapering portion 54 of the outer surface of the wellhead isolation tool. In an alternate embodiment not shown, the seals are fitted in grooves on the tapering inner surface portion of the body member. When the upper outer surface tapering portion of the wellhead isolation tool is mated with the tapering inner surface portion of the body member, the lock screws 40 penetrating the secondary flange 70 are aligned with the upper groove 212 formed on the wellhead isolation tool outer surface and the lock screws 40 penetrating the upper flange 42 of the body member 22 are aligned with lower groove 214 formed on the outer surface of the wellhead isolation tool. In an alternate embodiment, the mandrel may have to be rotated such that the lock screws 40 penetrating the secondary flange are aligned with a first set of depressions (not shown) formed on the wellhead isolation tool outer surface and the lock screws 40 penetrating the upper flange of the body member 22 are aligned with a second set depressions (not shown) formed on the outer surface of the wellhead isolation tool.

Now referring to FIG. 4A, lock screws 40 are threadedly inserted so that their frustum conical ends 66 engage the lower tapering surfaces 64 of their respective grooves 212, 214 formed on the outer surface of the exemplary wellhead isolation tool 60 thereby, retaining the wellhead isolation tool 60 within body member 22. With this embodiment, excess loads on the wellhead isolation tool 60 not absorbed by lock screws 40 installed in upper flange 42 are absorbed by lock screws 40 installed in secondary flange 70 and redistributed through studs 44 and nuts 45 to upper flange 42.

Now referring to FIG. 3, with the wellhead isolation tool 60 installed in the body member 22, the outer cylindrical surface 78 of the wellhead isolation tool lower portion 222 cooperates with inner surface 76 of the body member 22. Seals 82 are installed in grooves 84 formed in outer surface 78 of the wellhead isolation tool and cooperate with surfaces 76 to effect a seal between the body member 22 and the wellhead isolation tool 60. In an exemplary embodiment, the seals are self energizing seals such as for example O-ring, T-seal or S-seal types of seals. Alternatively, the seals may be fitted in the grooves formed on in the inner surface 76 of the body member. Pipe port 88 is radially formed through body member 22 and provides access for testing seals 82 prior to placing the wellhead isolation tool 60 in service. Subsequent to testing, pipe port 88 is sealed in an exemplary embodiment with pipe plug 90. Testing may be accomplished by applying air pressure through the pipe port 88 and monitoring the pressure for a decrease. A decrease in pressure of a predetermined amount over a predetermined time period may be indicative of seal leakage.

Cylindrical bores 34, 36 and 86 defined through the production casing 18, the exemplary embodiment wellhead isolation tool 60, and through an annular lip portion 87 the body member 22, respectively, are in an exemplary embodiment as shown in FIG. 3 equal in diameter thus providing an unrestricted passageway for fracturing materials and/or downhole tools.

Referring again to FIG. 1, valve 96 is connected to body member 22 by pipe nipple 94. Valve 96 may also be connected to the body member 22 by a flanged or studded outlet preparation. Valve 96 may then be opened during the fracturing process to bleed high pressures from cavity 98 in the event of leakage past seals 82.

Figure 2:
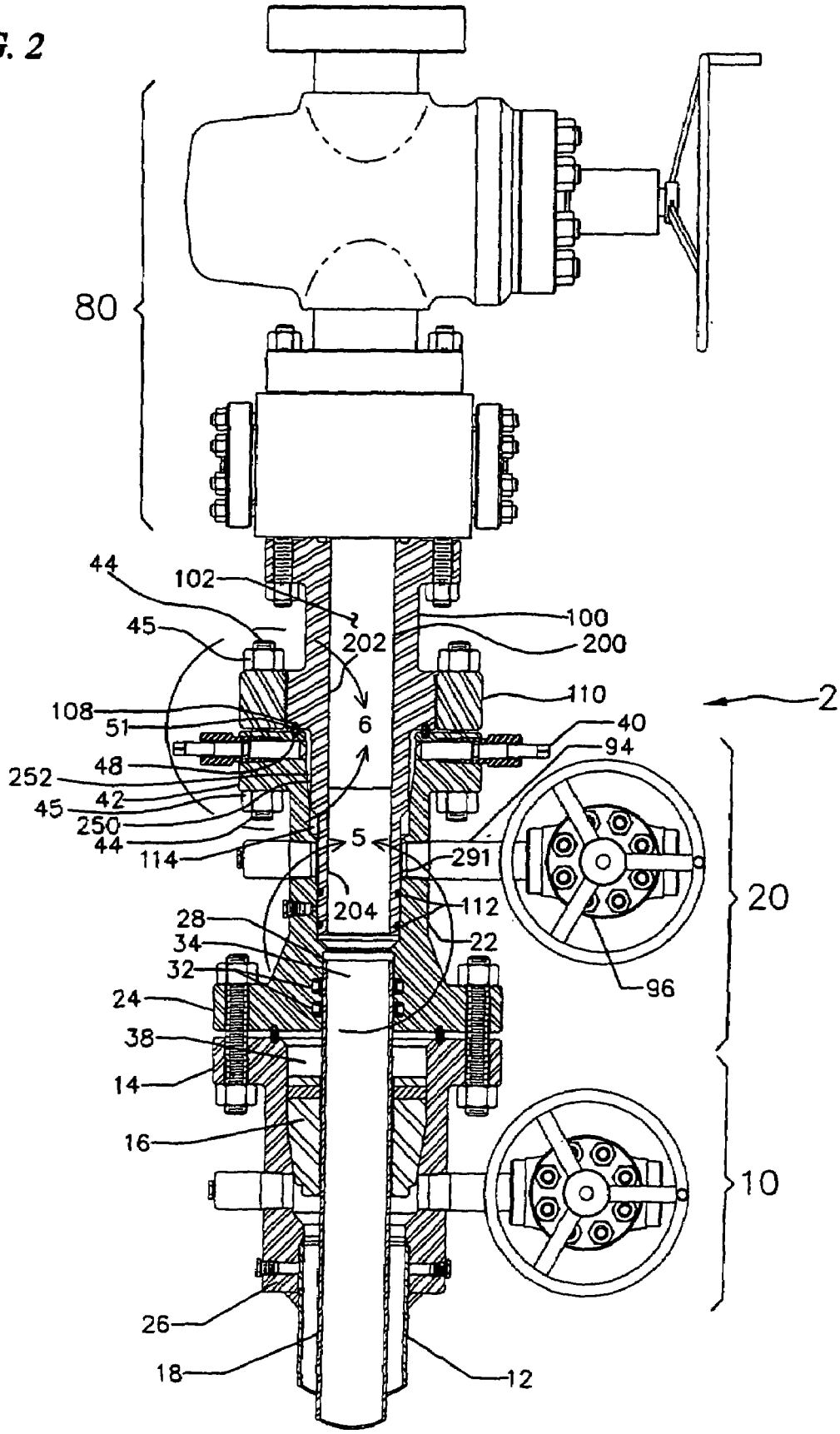
FIG. 2 is a partial cross-sectional view of a typical wellhead assembly with another exemplary embodiment wellhead isolation tool of the present invention and a fracturing tree assembly.

FIG. 2 shows another exemplary embodiment wellhead assembly 2 consisting of a lower housing assembly 10 also referred to herein as a casing head assembly; an upper assembly 80 also referred to herein as a fracturing tree; an intermediate body member assembly 20 also referred to herein as a body member assembly; and another exemplary embodiment wellhead isolation tool 100 also referred to herein as a wellhead isolation tool. It will be recognized by those practiced in the art that there may be differing configurations of wellhead assembly 2. Since the exemplary embodiment shown in FIG. 2 incorporates many of the same elements as the exemplary embodiment shown in FIG. 1, the same references numerals are used in both figures for the same elements. For convenience only the differences from the exemplary embodiment shown in FIG. 1 are described for illustrating the exemplary embodiment of FIG. 2.

Figure 6:
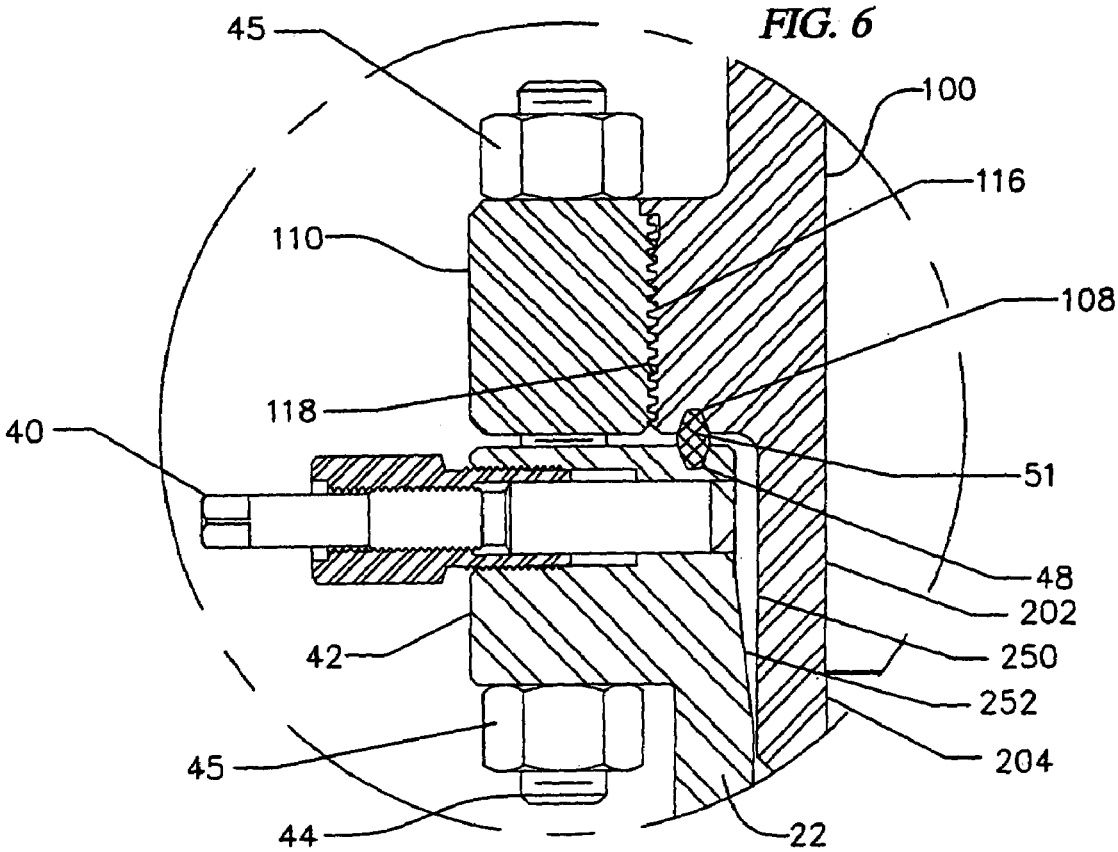
FIG. 6 is an enlarged cross-sectional view of the section encircled by arrow 6-6 in FIG. 2.

Now referring to FIG. 6, a secondary flange 110 is provided in an exemplary embodiment with threads 118, preferably ACME threads, on its inner cylindrical surface that cooperate with threads 116, also in an exemplary embodiment preferably ACME, on the outer cylindrical surface of wellhead isolation tool 100. In an alternate exemplary embodiment, secondary flange 110 may be incorporated as an integral part of wellhead isolation tool 100. However, the assembled tool may be produced more economically with a threaded on secondary flange 110 as for example shown in FIG. 6. The assembly of secondary flange 110 and wellhead isolation tool 100 is coupled to on the upper flange 42 of body member 22 utilizing a plurality of studs 44 and nuts 45. A standard sealing gasket 51 cooperates with a groove 108 formed in the wellhead isolation tool 100 and groove 48 in the upper flange 42 of body member 22 in order to maintain concentricity and a seal between wellhead isolation tool 100 and upper flange 42. With this embodiment, excess loads on the wellhead isolation tool 100 are transmitted to the flange 110 and redistributed through studs 44 and nuts 45 to upper flange 42.

Figure 5:
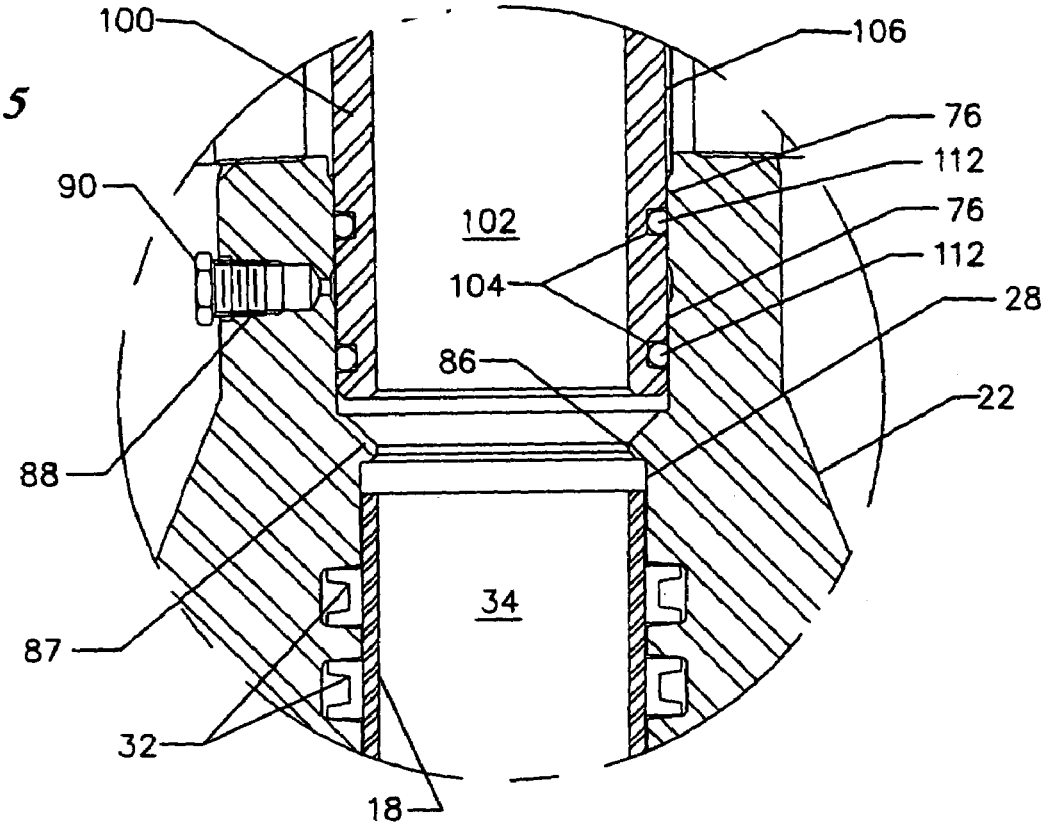
FIG. 5 is an enlarged cross-sectional view of the section encircled by arrow 5-5 in FIG. 2.

Now referring to FIG. 5, with the wellhead isolation tool 100 installed in body member 22, outer surface 106 of wellhead isolation tool 100 cooperates with cylindrical bore surface 76 of body member 22. Seals 112 installed in grooves 104 machined in outer surface 106 of wellhead isolation tool 100 cooperate with surfaces 76 to effect a seal between body member 22 and wellhead isolation tool 100. Alternatively, the seals are fitted in grooves formed on the inner bore surface 76 of body member 22 and cooperate with the outer surface 106 of the wellhead isolation tool. In the exemplary embodiment, the seals are self energizing seals as for example O-ring, T-seal and S-seal type seals. Other sealing schemes known in the art may also be used in lieu or in combination with the sealing schemes described herein.

As with the embodiment, shown in FIG. 1, pipe port 88 radially formed through body member 22 provides access for testing seals 112 prior to placing wellhead isolation tool 100 in service. Subsequent to testing, pipe port 88 is sealed with pipe plug 90. Cylindrical bores 34, 102 and 86 formed through the production casing 18, through the exemplary embodiment wellhead isolation tool 100, and through the annular lip portion on 87 of the body member 22, respectively, are in an exemplary embodiment equal in diameter thus providing an unrestricted passageway for fracturing materials and/or downhole tools.

Referring again to FIG. 2, valve 96 is connected to body member 22 by pipe nipple 94. Alternatively, the valve 96 may also be connected to body member 22 by a flanged or studded outlet preparation. Valve 96 may then be opened during the fracturing process to bleed high pressures from cavity 114 in the event of leakage past seals 112.

While the wellhead isolation tool has been described with having an upper tapering portion 54 formed on its outer surface which mates with a complementary tapering inner surface 52 of the body member 22, an alternate exemplary embodiment of the wellhead isolation tool does not have a tapering outer surface mating with the tapering inner surface portion 52 of the body member. With the alternate exemplary embodiment wellhead isolation tool, as for example shown in FIG. 2, the wellhead isolation tool has an outer surface 250 which mates with an inner surface 252 of the body member which extends below the tapering inner surface portion 52 of the body member 22. Features of the exemplary embodiment wellhead isolation tool shown in FIG. 1 can be interchanged with features of the exemplary embodiment wellhead isolation tool shown in FIG. 2. For example, instead of being coupled to a threaded secondary flange 110, the exemplary embodiment isolation tool may be coupled to the secondary flange 70 in the way shown in relation to the exemplary embodiment wellhead isolation tool shown in FIG. 1.

With any of the aforementioned embodiments, the diameter of the tubing head inner surface 291 (shown in FIGS. 1 and 2) immediately above the area where the lower portion of the wellhead isolation tool seals against the inner surface head of the tubing head is greater than the diameter of the inner surface of the tubing head against which the wellhead isolation tool seals and is greater than the outer surface diameter of the lower portion of the wellhead isolation tool. In this regard, the wellhead isolation tool with seals 32 can be slid into and seal against the body member of the tubing head assembly without being caught.

Figure 7A:
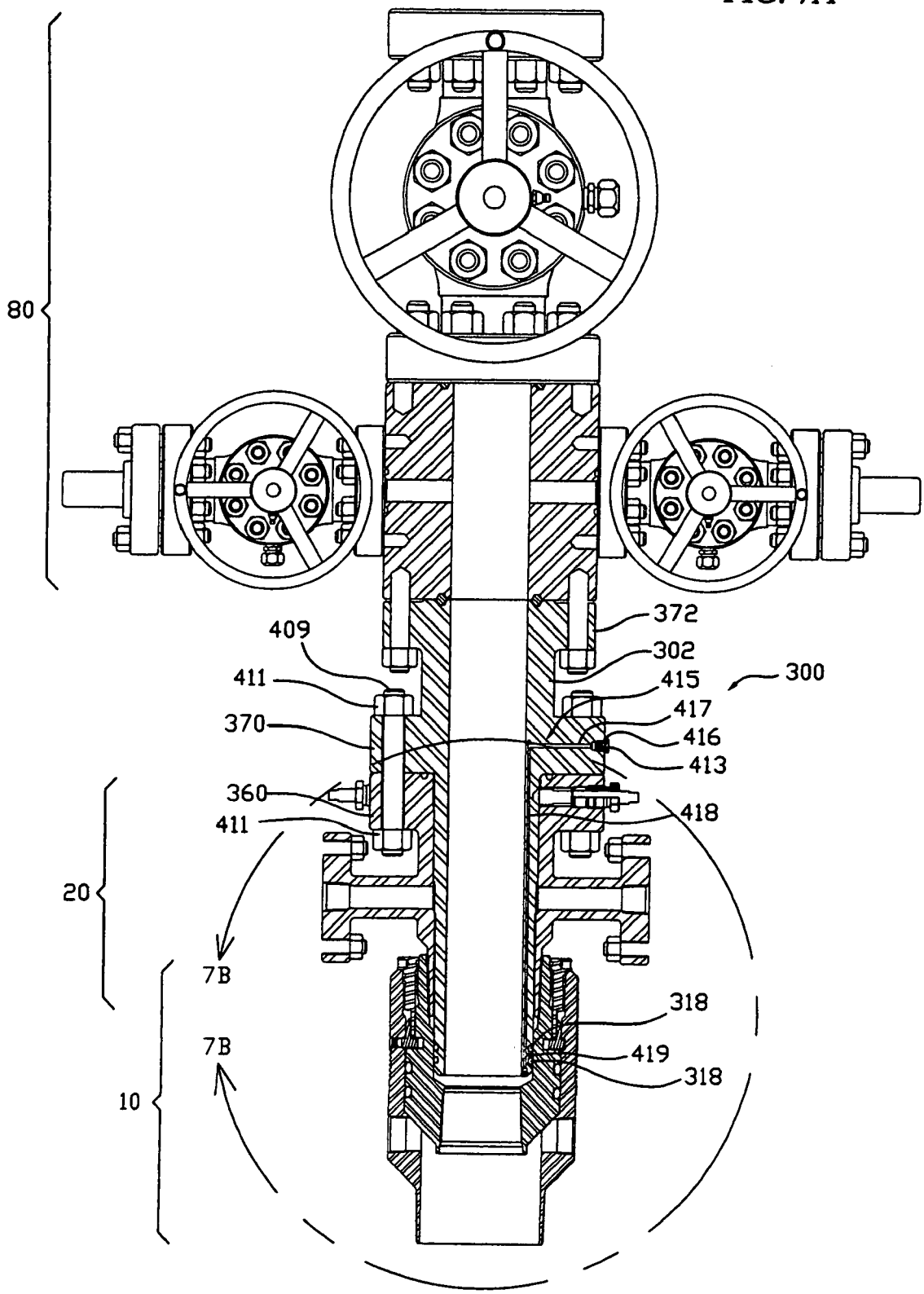
FIG. 7A is a partial cross-sectional view of an exemplary embodiment wellhead assembly incorporating an exemplary embodiment wellhead isolation tool of the present invention.
Figure 7B:
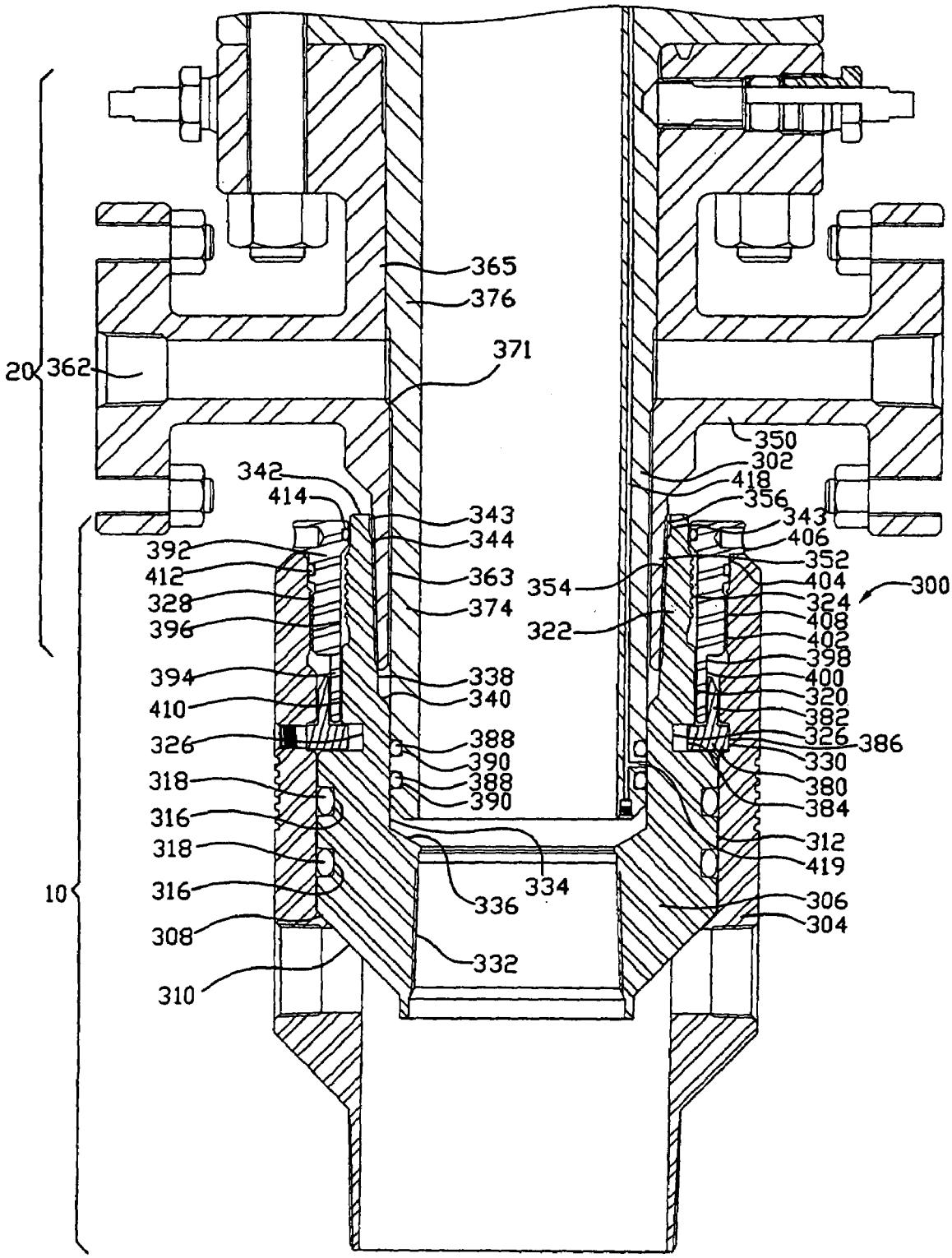
FIG. 7B is an enlarged cross-sectional view of the area encircled by arrow 7B-7B in FIG. 7A.

A further exemplary embodiment assembly 300 comprising a further exemplary embodiment wellhead isolation tool or frac mandrel 302, includes a lower housing assembly 10 also referred to herein as a casing head assembly, an upper assembly 80 also referred to herein as a fracturing tree, and intermediate body assembly 20 also referred to herein as a tubing head assembly, and the intermediate wellhead isolation tool 302 also referred to herein as a frac mandrel, as shown in FIGS. 7A and 7B. The casing head assembly includes a casing head 304 into which is seated a mandrel casing hanger 306. The casing head 304 has an internal annular tapering surface 308 on which is seated a complementary outer tapering surface 310 of the mandrel casing hanger. The tapering outer surface 310 of the mandrel casing hanger defines a lower portion of the mandrel casing hanger. Above the tapering outer surface of the mandrel casing hanger extends a first cylindrical outer surface 312 which mates with a cylindrical inner surface of the casing head 304. One or more annular grooves, as for example two annular grooves 316 are defined in the first cylindrical outer surface 312 of the mandrel casing hanger and accommodate seals 318. In the alternative, the grooves may be formed on the inner surface of the casing head port for accommodating the seals.

The mandrel casing hanger 306 has a second cylindrical outer surface 320 extending above the first cylindrical outer surface 312 having a diameter smaller than the diameter of the first cylindrical outer surface. A third cylindrical outer surface 322 extends from the second cylindrical outer surface and has a diameter slightly smaller than the outer surface diameter of the second cylindrical outer surface. External threads 324 may be formed on the outer surface of the third cylindrical surface of the mandrel casing hanger. An outer annular groove 326 is formed at the juncture between the first and second cylindrical outer surfaces of the mandrel casing hanger. Internal threads 328 are formed at the upper end of the inner surface of the casing head. An annular groove 330 is formed in the inner surface of the mandrel casing head.

The inner surface of the mandrel casing hanger has three major sections. A first inner surface section 332 at the lower end which may be a tapering surface, as for example shown in FIG. 7B. A second inner surface 334 extends from the first inner surface section 332. In the exemplary embodiment shown in FIG. 7B, a tapering annular surface 336 adjoins the first inner surface to the second major inner surface. A third inner surface 338 extends from the second inner surface. An annular tapering surface 340 adjoins the third inner surface to the second inner surface. An upper end 342 of the third inner surface of the mandrel casing hanger increases in diameter forming a counterbore 343 and a tapered thread 344.

Body member 350 also known as a tubing head of the tubing head assembly 20 has a lower cylindrical portion 352 having an outer surface which in the exemplary embodiment threadedly cooperates with inner surface 354 of the third inner surface section of the mandrel casing hanger. A protrusion 356 is defined in an upper end of the lower cylindrical section of the body member 350 for mating with the counterbore 343 formed at the upper end of the third inner surface of the mandrel casing hanger. The body member 350 has an upper flange 360 and ports 362. The inner surface of the body member is a generally cylindrical and includes a first section 363 extending to the lower end of the body member. In the exemplary embodiment shown in FIGS. 7A and 7B, the first section extends from the ports 362. A second section 365 extends above the ports 362 and has an outer diameter slightly greater than that of the first section.

The wellhead isolation tool has a first external flange 370 for mating with the flange 360 of the body member of the tubing head assembly. A second flange 372 is formed at the upper end of the wellhead isolation tool for mating with the upper assembly 80. A generally cylindrical section extends below the first flange 370 of the wellhead isolation tool. The generally cylindrical section has a first lower section 374 having an outer surface diameter equal or slightly smaller than the inner surface diameter of the first inner surface section of the body member of the tubing head assembly. A second section 376 of the wellhead isolation tool cylindrical section extending above the first lower section 374 has an outer surface diameter slightly smaller than the inner surface diameter of the second section 365 of the body member 350 and greater than the outer surface diameter of the first lower section 374. Consequently, an annular shoulder 371 is defined between the two outer surface sections of the wellhead isolation tool cylindrical section. The well head isolation tool is fitted within the cylindrical opening of the body member of the tubing head assembly such that the flange 370 of the wellhead isolation tool mates with the flange 360 of the body member 350. When that occurs, the annular shoulder 371 defined between the two outer surface sections of the cylindrical section of the wellhead isolation tool mates with the portion of the first section inner surface 363 of the body member 350.

Prior to installing the mandrel casing hanger into the casing head, a spring loaded latch ring 380 is fitted in the outer groove 326 of the mandrel casing hanger. The spring loaded latch ring has a generally upside down "T" shape in cross section comprising a vertical portion 382 and a first horizontal portion 384 for sliding into the outer annular groove 326 formed on the mandrel casing hanger. A second horizontal portion 386 extends from the other side of the vertical portion opposite the first horizontal portion.

The spring loaded latch ring is mounted on the mandrel casing hanger such that its first horizontal portion 384 is fitted into the external groove 326 formed in the mandrel casing hanger. The spring loaded latch ring biases against the outer surface of the mandrel casing hanger. When fitted into the external annular groove 326 formed in the mandrel casing hanger, the outer most surface of the second horizontal portion 386 of the latch ring has a diameter no greater than the diameter of the first outer surface section 312 of the mandrel casing hanger. In this regard, the mandrel casing hanger with the spring loaded latch ring can be slipped into the casing head so that the tapering outer surface 310 of the mandrel casing hanger can sit on the tapering inner surface portion 308 of the casing head.

In the exemplary embodiment, once the mandrel casing hanger is seated onto the casing head, the body member 350 of the tubing head assembly is fitted within the casing head such that the lower section of the outer surface of the body member threads on the third section inner surface of the mandrel casing hanger such that the protrusion 356 formed on the outer surface of the body member is mated within the counterbore 343 formed on the upper end of the third section inner surface of the mandrel casing hanger. The wellhead isolation tool is then fitted with its cylindrical section within the body member 350 such that the flange 370 of the wellhead isolation tool mates with the flange 360 of the body member. When this occurs, the annular shoulder 371 formed on the cylindrical section of the wellhead isolation tool mates with the first section 363 of the inner surface of the body member 350. Similarly, the lower outer surface section of the cylindrical section of the wellhead isolation tool mates with the inner surface second section 334 of the mandrel casing hanger. Seals 388 are provided in grooves formed 390 on the outer surface of the lower section of the cylindrical section of the wellhead isolation tool to mate with the second section inner surface of the mandrel casing hanger. In the alternative, the seals may be positioned in grooves formed on the second section inner surface of the mandrel casing hanger. In the exemplary embodiment, the seals are self-energizing seals, as for example, O-ring, T-seal or S-seal type seals.

A top nut 392 is fitted between the mandrel casing hanger upper end portion and the upper end of the casing head. More specifically, the top nut has a generally cylindrical inner surface section having a first diameter portion 394 above which extends a second portion 396 having a diameter greater than the diameter of the first portion. The outer surface 398 of the top nut has four sections. A first section 400 extending from the lower end of the top nut having a first diameter. A second section 402 extending above the first section having a second diameter greater than the first diameter. A third section 404 extending from the second section having a third diameter greater than the second diameter. And a fourth section 406 extending from the third section having a fourth diameter greater than the third diameter and greater than the inner surface diameter of the upper end of the mandrel casing hanger. Threads 408 are formed on the outer surface of the second section 402 of the top nut for threading onto the internal threads 328 formed on the inner surface of the upper end of the mandrel casing head. The top nut first and second outer surface sections are aligned with the first inner surface section of the top nut. In this regard, a leg 410 is defined extending at the lower end of the top nut.

The top nut is threaded on the inner surface of the casing head. As the top nut moves down on the casing head, the leg 410 of the top nut engages the vertical portion 382 of the spring loaded latch ring, moving the spring loaded latch ring radially outwards against the latch ring spring force such that the second horizontal portion 386 of the latch ring slides into the groove 330 formed on the inner surface of the casing head while the first horizontal portion remains within the groove 326 formed on the outer surface of the mandrel casing head. In this regard, the spring loaded latch ring along with the top nut retain the mandrel casing hanger within the casing head.

A seal 412 is formed on the third outer surface section of the top nut for sealing against the casing head. In the alternative the seal may be formed on the casing head for sealing against the third section of the top nut. A seal 414 is also formed on the second section inner surface of the top nut for sealing against the outer surface of the mandrel casing hanger. In the alternative, the seal may be formed on the outer surface of the casing hanger for sealing against the second section of the inner surface of the top nut.

To check the seal between the outer surface of the lower section of the cylindrical section of the wellhead isolation tool and the inner surface of the mandrel casing hanger, a port 416 is defined radially through the flange 370 of the wellhead isolation tool. The port provides access to a passage 415 having a first portion 417 radially extending through the flange 370, a second portion 418 extending axially along the cylindrical section of the wellhead isolation tool, and a third portion 419 extending radially outward to a location between the seals 388 formed between the lower section of the wellhead isolation tool and the mandrel casing hanger. Pressure, such as air pressure, may be applied to port 416 to test the integrity of the seals 388. After testing the port 416 is plugged with a pipe plug 413.

With any of the aforementioned exemplary embodiment wellhead isolation tools, a passage such as the passage 415 shown in FIG. 7A, may be provided through the body of the wellhead isolation to allow for testing the seals or between the seals at the lower end of the wellhead isolation tool from a location on the wellhead isolation tool remote from such seals.

The upper assembly is secured on the wellhead isolation tool using methods well known in the art such as bolts and nuts. Similarly, an exemplary embodiment wellhead isolation tool is mounted on the tubing head assembly using bolts 409 and nuts 411.

Figure 8:
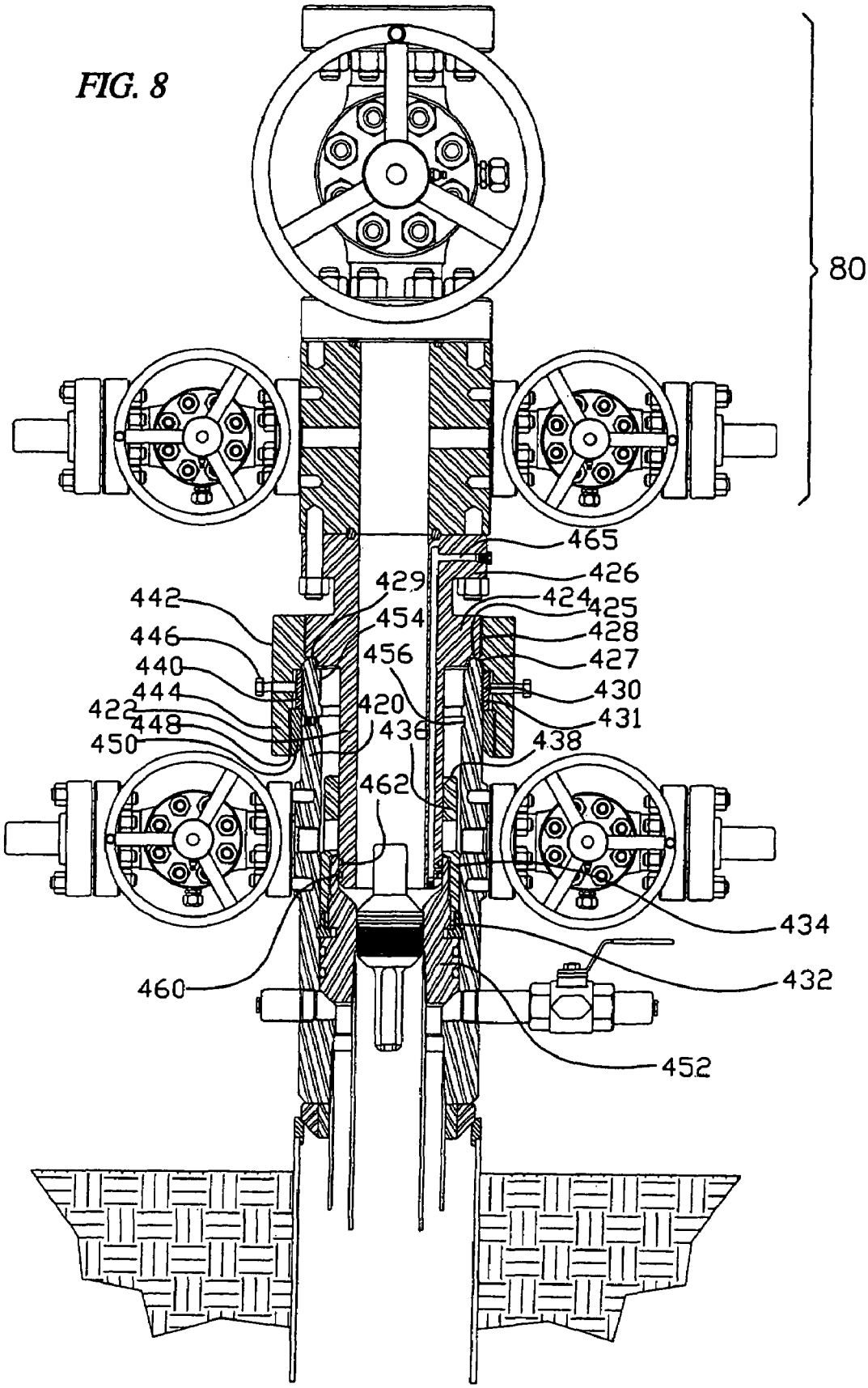
FIG. 8 is a partial cross-sectional view of another exemplary embodiment wellhead assembly incorporating another exemplary embodiment wellhead isolation tool of the present invention.

In another exemplary embodiment assembly of the present invention shown in FIG. 8, a combination tubing head/casing head body member 420 is used instead of a separate tubing head and casing head. Alternatively, an elongated tubing head body member coupled to a casing head may be used. In the exemplary embodiment shown in FIG. 8, the body member is coupled to the wellhead. A wellhead isolation tool 422 used with this embodiment comprises an intermediate flange 424 located below a flange 426 interfacing with the upper assembly 80. An annular step 425 is formed on the lower outer periphery of the intermediate flange. When the wellhead isolation tool 422 is fitted in the body member 420, the annular step 425 formed on the intermediate flange seats on an end surface 427 of the body member. A seal 429 is fitted in a groove formed on the annular step seals against the body member 420. Alternatively the groove accommodating the seal may be formed on the body member 420 for sealing against the annular step 425. Outer threads 428 are formed on the outer surface of the intermediate flange 424. When fitted into the body member 420, the intermediate flange 424 sits on an end portion of the body member 420. External grooves 430 are formed on the outer surface near an upper end of the body member defining wickers. In an alternate embodiment threads may be formed on the outer surface near the upper end of the body member.

With this exemplary embodiment, a mandrel casing hanger 452 is mated and locked against the body member 420 using a spring loaded latch ring 432 in combination with a top nut 434 in the same manner as described in relation to the exemplary embodiment shown in FIGS. 7A and 7B. However, the top nut 434 has an extended portion 436 defining an upper surface 438 allowing for the landing of additional wellhead structure as necessary. For example, another hanger (not shown) may be landed on the upper surface 438. In another exemplary embodiment, internal threads 454 are formed on the inner surface of the body member to thread with external threads formed in a second top nut which along with a spring latch ring that is accommodated in groove 456 formed on the inner surface of the body member 420 can secure any additional wellhead structure such as second mandrel seated on the top of the extended portion of top nut 434.

Once the wellhead isolation tool 422 is seated on the body member 420, a segmented lock ring 440 is mated with the wickers 430 formed on the outer surface of the body member. Complementary wickers 431 are formed on the inner surface of the segmented lock ring and intermesh with the wickers 430 on the outer surface of the body member. In an alternate embodiment, the segmented lock ring may be threaded to a thread formed on the outer surface of the body member. An annular nut 442 is then threaded on the threads 428 formed on the outer surface of the intermediate flange 424 of the wellhead isolation tool. The annular flange has a portion 444 that extends over and surrounds the segmented lock ring. Fasteners (i.e., load applying members) 446 are threaded through the annular nut and apply pressure against the segmented lock ring 440 locking the annular nut relative to the segmented lock ring.

Figure 9:
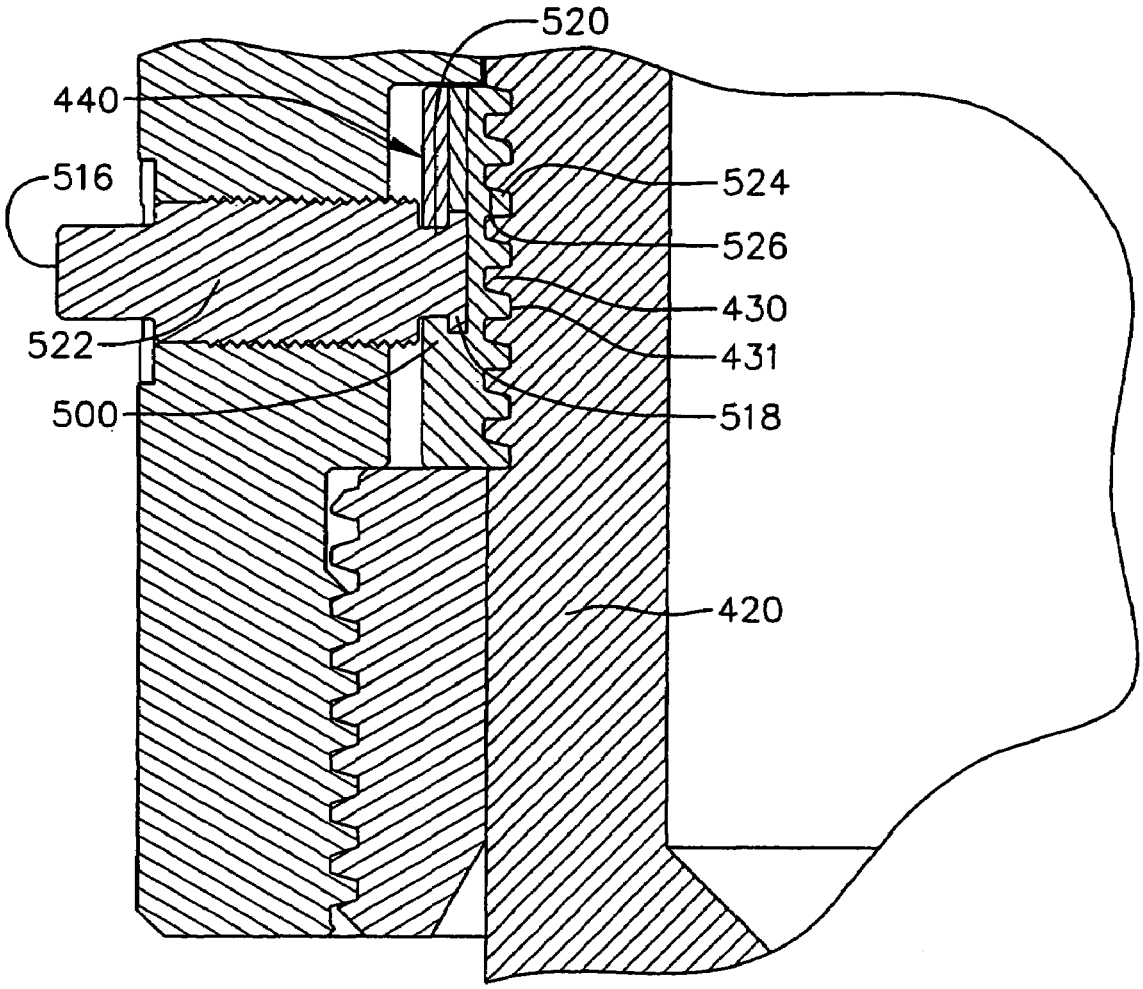
FIG. 9 is a partial cross-sectional view of an exemplary embodiment connection between an annular nut and a body member of an exemplary embodiment wellhead assembly.
Figure 10:
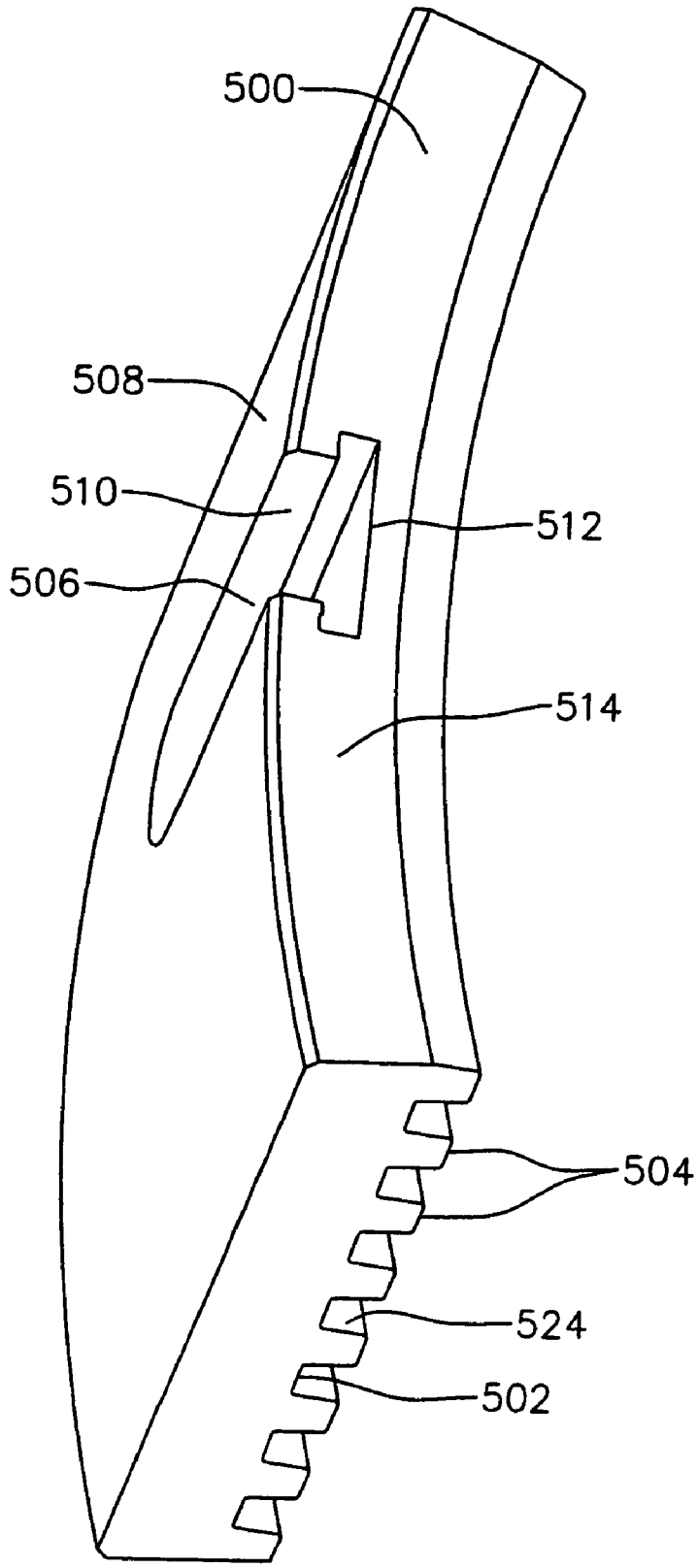
FIG. 10 is a perspective view of an exemplary embodiment segment of a segmented lock ring incorporated in the connection shown in FIG. 9.

In an exemplary embodiment, the segmented lock ring 440 is formed from segments 500 as for example shown in FIGS. 9 and 10. On their inner surface 502 the segments have wickers 504. A slot 506 is formed through the outer surface 508 of the segment 500. The slot has a narrower portion 510 extending to the outer surface 508 and a wider portion 512 adjacent the narrower portion defining a dove-tail type of slot in cross-section. In the exemplary embodiment the slot extends from an upper edge 514 of the segment to a location proximate the center of the segment. In alternate embodiments, the slot an extend from any edge of the segment and may extend to another edge or any other location on the segment. With these exemplary embodiments, a fastener (i.e., a load applying member) 516 as shown in FIG. 9 is used with each segment instead of fastener 446. The fastener 516 has a tip 518 having a first diameter smaller than the width of the slot wider portion but greater than the width of the slot narrower portion. A neck 520 extends from the tip to the body 522 of the fastener. The neck has diameter smaller than the width of the slot narrower portion. The tip and neck slide within dove-tail slot 506, i.e. the tip slides in the wider section of the slot and the neck slider in the slot narrower section and mechanically interlock with the segment 500.

In some exemplary embodiments, as for example the exemplary embodiment shown in FIG. 10, the wickers formed on the segment 500 have tapering upper surfaces 524 which mate with tapering lower surfaces on the wickers formed on the body member 420. Alternatively, the segment wicker lower surfaces are tapered for mating with body member wicker upper surfaces. In other embodiments, both the upper and lower surfaces of the wickers are tapered. In yet further exemplary embodiments, the wickers do not have tapering surfaces. By tapering the surfaces of the wickers, as for example the upper surfaces of the segment wickers, more wicker surface area becomes available for the transfer of load.

When one set of wicker surfaces are tapered, as for example, the upper or lower surfaces, then, by orienting the slot 506 to extend to one edge of the segment, as for example the upper edge as shown in FIGS. 9 and 10, the segment installer will know that the segment wicker tapered surfaces are properly oriented when the slot 506 is properly oriented. For example, when the segment 500 is mounted with the slot 506 extending to the upper edge of the segment, proper mating of the wicker tapered surfaces formed on the segment and on the body member 420 is assured.

An internal thread 448 is formed on the lower inner surface of the annular nut 442. A lock nut 450 is threaded onto the internal thread 448 of the annular nut and is sandwiched between the body member 420 and the annular nut 442. In the exemplary embodiment shown in FIGS. 8 and 9, the lock nut 450 is threaded until it engages the segmented locking ring 440. Consequently, the wellhead isolation tool 422 is retained in place seated on the body member 420.

The connection using the segmented lock ring 450 and lock nut can be used to couple all types of wellhead equipment including the body member 420 to the annular nut 442 as described herein. Use of a segmented lock ring and lock nut allows for the quick coupling and decoupling of the wellhead assembly members.

Seals 460 are formed between a lower portion of the wellhead isolation tool 422 and an inner surface of the hanger 452. This is accomplished by fitting seals 460 in grooves 462 formed on the outer surface of the wellhead isolation tool 422 for sealing against the inner surface of hanger 452. Alternatively the seals may be fitted in grooves formed on the inner surface of the hanger 452 for sealing against the outer surface of the wellhead isolation tool. To check the seal between the outer surface of the wellhead isolation tool 422 and the inner surface of the hanger 452, a port 465 is defined through the flange 426 of the wellhead isolation tool and down along the well head isolation tool to a location between the seals 460 formed between the wellhead isolation tool and the hanger 452.

With any of the aforementioned embodiment, one or more seals may be used to provide the appropriate sealing. Moreover, any of the aforementioned embodiment wellhead isolation tools and assemblies provide advantages in that they isolate the wellhead or tubing head body from pressures of refraction in process while at the same time allowing the use of a valve instead of a BOP when forming the upper assembly 80. In addition, by providing a seal at the bottom portion of the wellhead isolation tool, each of the wellhead isolation exemplary embodiment tools of the present invention isolate the higher pressures to the lower sections of the tubing head or tubing head/casing head combination which tend to be heavier sections and can better withstand the pressure loads. Furthermore, they allow for multiple fracturing processes and allow the wellhead isolation tool to be used in multiple wells without having to use a BOP between fracturing processes from wellhead to wellhead. Consequently, multiple BOPs are not required when fracturing multiple wells.

Figure 11:
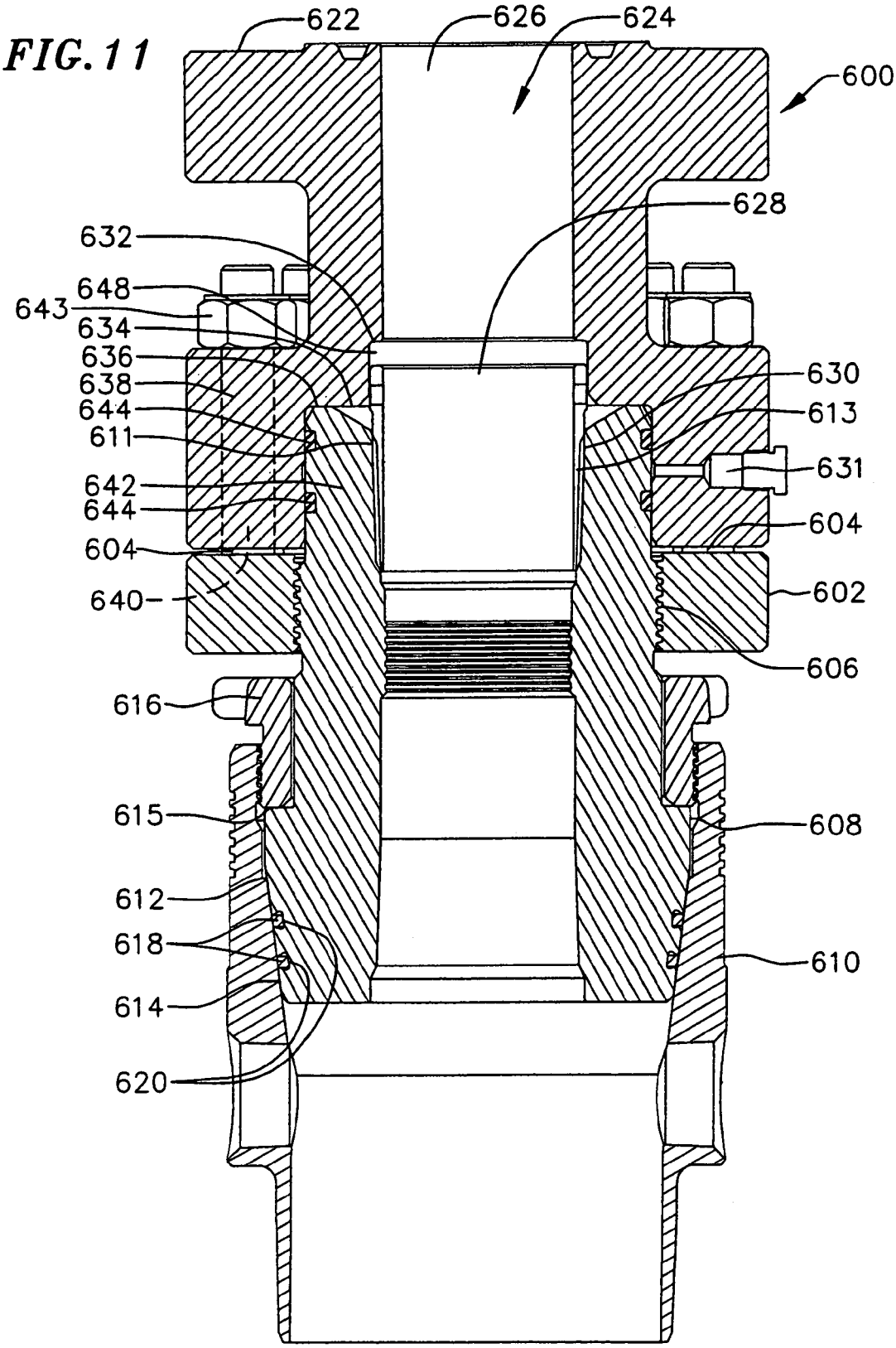
FIG. 11 is a partial cross-sectional view of an exemplary embodiment wellhead isolation tool of the present invention, mounted on a well for fracturing.

In another exemplary embodiment, as shown in FIG. 11, a robust isolation tool or isolation mandrel 600 to contain the fracturing media is provided. The exemplary embodiment isolation tool is attached to a service valve (not shown) by a conventional flanged connection. A threaded collar nut 602 with studs 604 is installed by threads 606 machined into the outside diameter of a tubing mandrel hanger 608. In exemplary embodiments, the collar nut has four or more studs equidistantly spaced around the nut. In the exemplary embodiment shown in FIG. 11, the collar nut has 12 studs equidistantly spaced around the collar nut. An exemplary embodiment tubing mandrel hanger 608 as shown in FIG. 11, is seated on a casing head 610. The tubing mandrel hanger has an central bore 611 formed longitudinally through the center of the tubing mandrel hanger. A wear sleeve 613 is fitted within the central bore 611 to minimize damaging effects of the fracturing media.

The tubing mandrel hanger has a tapering lower outer surface portion 612 such that the outer surface diameter is reduced in an downward direction. The casing head has a tapering inner surface portion 614 that is complementary to the tapering outer surface portion 612 of the tubing mandrel hanger. When seated on the casing head, the tapering inner surface portion 612 of the tubing mandrel hanger is seated on the tapering inner surface of the casing head. An annular shoulder 617 is formed above the tapering outer surface portion of the tubing mandrel hanger.

A top nut 616 is threaded on an inner surface of the casing head and over the shoulder 617. As the casing head top nut is threaded on the casing head it exerts a force on the shoulder 617 for retaining the tubing mandrel hanger on the casing head. One or more seals are positioned between the two tapering outer surfaces for providing a seal between the tubing head and the tubing mandrel hanger. In the exemplary embodiment shown in FIG. 11, two seals 618 are positioned within annular grooves 620 formed on the outer surface of the tubing mandrel hanger. Alternatively, the seals may be mounted in grooves formed on the inner surface of the casing head.

The isolation tool 600, in the exemplary embodiment shown in FIG. 11 has an end flange 622 for the attachment of equipment (not shown). The exemplary isolation tool has a longitudinal central opening 624. The central opening 624 has a first section 626 from which extends a second section 628 from which a extends a third section 630. The second section has a diameter greater than the first section. The third section has a diameter greater than the second section. A first inner annular shoulder 632 is defined between the first and second sections of the central opening. A second inner annular shoulder 634 is defined between the second and third sections of the central opening 624. A second flange 638, spaced apart from the end flange 622, extends externally and spans the second and third sections of the central opening.

The isolation tool is fitted over the tubing mandrel hanger 608 and the studs 604 of the collar nut 602 penetrate openings 640 formed through the second flange 638. Nuts 643 are installed on the studs and tightened, thus securing the isolation tool to the tubing mandrel hanger. When fitted over the tubing mandrel hanger, the third section 630 of the central opening 624 of the isolation tool surrounds the outer surface of the tubing mandrel hanger. The second inner annular shoulder 636 of the isolation tool is seated on an end 646 of the tubing mandrel hanger. The first inner annular shoulder 632 of the isolation tool is positioned over an end 648 of the wear sleeve. The central opening 624 of the isolation tool is also aligned with the central bore 611 of the tubing mandrel hanger.

One or more seals are formed between the isolation tool and the tubing mandrel hanger. In the exemplary embodiment, two annular grooves 642 are formed on the outer surface of the tubing mandrel hanger. A seal 644, such as an O-ring seal, is fitted in each groove for sealing against the inner surface of the third section 630 of the central opening 624 of the isolation tool. In an alternate exemplary embodiment, the grooves are formed on the inner surface of the third section of the central opening of the isolation tool. Seals are fitted within these grooves for sealing against the outer surface of the tubing mandrel hanger. A test port 631 is defined through the second flange and the third section of the central opening of the isolation tool for testing the integrity of the seal between the isolation tool and the tubing mandrel hanger. When the isolation tool is mounted on the tubing mandrel hanger in the exemplary embodiment shown in FIG. 11, the test port is located between the two seals 644.

Figure 12:
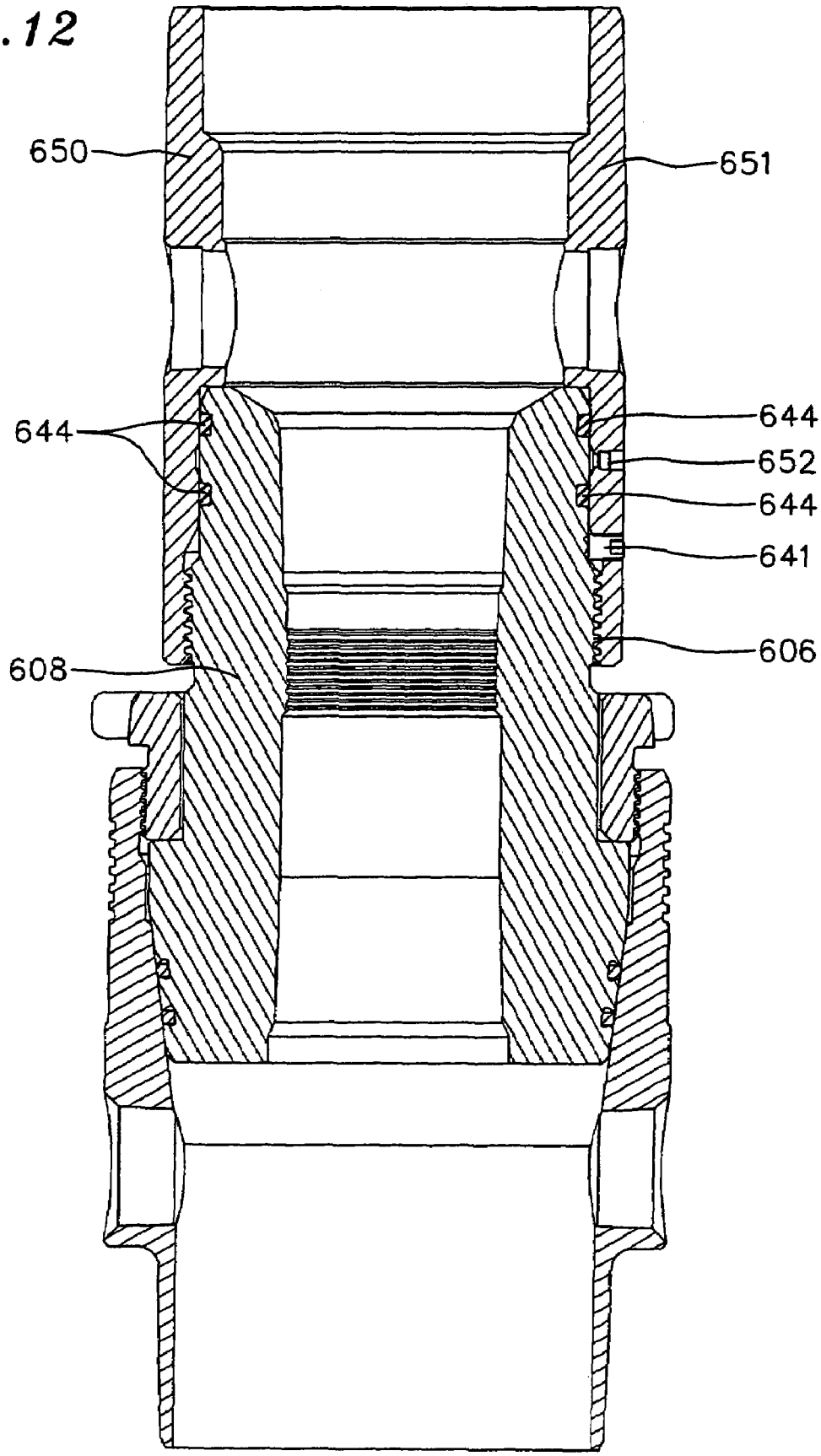
FIG. 12 is a partial cross-sectional view of a completed well after removal of the exemplary embodiment of wellhead isolation tool shown in FIG. 11.

After completion of the fracturing process, the isolation tool, the collar nut with studs and the wear sleeve are removed and an independent tubing head 650, as shown in FIG. 12, is installed along with the remainder of the completion equipment (not shown). In the exemplary embodiment shown in FIG. 12, the independent tubing head is threaded onto the threads 606 formed on the outer surface of the tubing mandrel hanger 608 on which were threaded the collar nut. In the exemplary embodiment shown in FIG. 12, one or more set screws 641 are threaded onto the independent tubing head and engage the tubing mandrel hanger for preventing rotation of the independent tubing head after installation is completed.

In the embodiment shown in FIG. 12 the seals 644 that were mounted on the tubing mandrel hanger form a seal against the inner surface of the independent tubing head. In the embodiment where the seals are mounted on the isolation tool and not on the tubing mandrel hanger, seals will be mounted on the inner surface, as for example in grooves formed on the inner surface, of the independent tubing head. A test port 652 is formed though the independent tubing head for testing the integrity of the seal between the independent tubing head and the tubing mandrel hanger. When the independent tubing head is installed on the tubing mandrel hanger, the test port is positioned between the two seals 644.

As can be seen from FIGS. 11 and 12, the isolation tool, the tubing mandrel hanger, the casing head, the tubing head and the collar nut are all generally tubular members. Moreover, instead of a tubing head mandrel hanger, another type of hanger typically used in wellhead assemblies may also be used.

The wellhead isolation tools of the present invention as well as the wellhead assemblies used in combination with the wellhead tools of the present invention including, among other things, the tubing heads and casing heads may be formed from steel, steel alloys and/or stainless steel. These parts may be formed by various well known methods such as casting, forging and/or machining.

While the present invention will be described in connection with the depicted exemplary embodiments, it will be understood that such description is not intended to limit the invention only to those embodiments, since changes and modifications may be made therein which are within the full intended scope of this invention as hereinafter claimed. For example, instead of the top nut 616, the tubing mandrel hanger may be retained on the casing head using a latch ring 380 with top nut 392 as for example shown in FIG. 7B. With this embodiment, the outer surface of the tubing mandrel hanger and the inner surface of the tubing head will have to be appropriately configured to accept the latch ring and the top nut. Moreover, instead of a casing head, the mandrel hanger may be seated on a casing, a tubing head, or other tubular member. Furthermore, instead of being threaded on to the tubing mandrel hanger, the collar nut may be coupled to the tubing head mandrel using a segmented lock ring with wickers as for example shown in FIG. 9. With this embodiment, the segmented lock ring may be coupled to the collar nut or may extend axially from the collar nut. Similarly, with this embodiment, the outer surface of the tubing mandrel hanger will have be formed with wickers rather than threads. With such an exemplary embodiment, the independent tubing head or other tubular that is coupled to the tubing mandrel hanger after completion or the fracturing process will also have to be formed with wickers on its inner surface so that it can engage the wickers on the outer surface of the tubing mandrel hanger or other tubular member.

What is claimed is:

1. A wellhead assembly comprising:

a casing;

a first tubular member over the casing;

a first tubular member flange extending from the first tubular member;

a generally elongate annular member suspended in the first tubular member, said annular member having a first end portion extending above the first tubular member and a second end portion below the first end portion;

a second flange extending from the elongate annular member;

a plurality of fasteners fastening the second flange to the first tubular member flange;

a hanger within the casing, wherein a seal is interposed between the second end portion and the hanger; and a production tubular member aligned with the elongate annular member, wherein an axial force acting on the generally elongate annular member will be reacted in both the first tubular member flange and the second flange, wherein the hanger comprises an inner surface, wherein the seal is interposed between the inner surface of the hanger and an outer surface of the second end portion of the elongate annular member.

2. A wellhead assembly as recited in claim 1 wherein the second flange is separate from the generally elongate annular member.

3. A wellhead assembly as recited in claim 1 wherein the generally elongate annular member is a wellhead isolation tool.

4. A wellhead assembly comprising:

a casing;

a first tubular member over the casing comprising an inner lip portion;

a first tubular member flange extending from the first tubular member;

a generally elongate annular member hanging in the first tubular member, said annular member having a first end portion extending above the first tubular member and a second end portion below the first end portion, wherein the elongate annular member is a wellhead isolation tool;

a second flange extending from the elongate annular member;

a fastener fastening the second flange to the first tubular member flange;

a seal interposed between the elongate annular member second end portion and the first tubular member, wherein the seal is between the elongate annular member second end portion and a first inner surface section of the first tubular member, wherein the first tubular member comprises a second inner surface section immediately above and concentric with the first inner surface section, said second inner surface section having a diameter greater than a diameter of said first inner surface section; and a production tubular member aligned with the elongate annular member, wherein the inner lip portion extends between the generally elongate annular member and the production tubular member, wherein an axial force acting on the generally elongate annular member will be reacted in both the first tubular member flange and the second flange.

5. A wellhead assembly as recited in claim 4 wherein the elongate annular member comprises an inner diameter, wherein the lip portion comprises an inner diameter and wherein the production tubing comprises an inner diameter wherein the inner diameter of said elongate annular member, lip portion and production tubing are equal.

6. A wellhead assembly as recited in claim 4 wherein the second flange is separate from the generally elongate annular member.

7. The wellhead assembly as recited in claim 4 wherein said first tubular member comprises an inner surface and wherein said generally elongate annular member is suspended by said first tubular member inner surface.

8. A wellhead assembly as recited in claim 4 further comprising a member coupled to the second flange and engaging the generally elongate annular member, said member retaining said generally elongate annular member in an axial direction.

9. A wellhead assembly as recited in claim 8 further comprising another member coupled to the first tubular member flange and engaging the generally elongate annular member, said another member retaining said generally elongate annular member in an axial direction.

10. A wellhead assembly comprising:

a casing;

a first tubular member over the casing comprising an inner lip portion;

a first tubular member flange extending from the first tubular member;

a generally elongate annular member hanging in the first tubular member, said annular member having a first end portion extending above the first tubular member and a second end portion below the first end portion;

a second flange extending from the elongate annular member;

a fastener fastening the second flange to the first tubular member flange;

a member coupled to one of said flanges and engaging the generally elongate annular member, said member retaining said generally elongate annular member in an axial direction;

another member coupled to the other of said flanges and engaging the generally elongate annular member, said another member retaining said generally elongate annular member in an axial direction; and a production tubular member aligned with the elongate annular member, wherein an axial force acting on the generally elongate annular member will be reacted in both the first tubular member flange and the second flange.

11. The wellhead assembly as recited in claim 10 wherein said first tubular member comprises an inner surface and wherein said generally elongate annular member is suspended by said first tubular member inner surface.

12. A wellhead assembly comprising:

a first tubular member;

a second tubular member over the first tubular member;

a first flange extending from the second tubular member;

a generally elongate annular member hanging in said second tubular member, said generally elongate annular member having a first portion extending above the second tubular member and a second portion below the first portion;

a second flange threaded to the generally elongate annular member, wherein said second flange is fastened to said first flange, and wherein an axial load acting on said generally elongate annular member will be reacted in both the first and second flanges;

at least a fastener radially penetrating said first flange for fastening said generally elongate annular member to said second tubular member; and a production tubing axially aligned with the generally elongate annular member.

13. A wellhead assembly as recited in claim 12 further comprising a casing, wherein said first tubular member is mounted over the casing.

14. The wellhead assembly as recited in claim 12 wherein said second tubular member comprises an inner surface and wherein said generally elongate annular member is suspended by said second tubular member inner surface.

15. A wellhead assembly as recited in claim 12 wherein the generally elongate annular member is a wellhead isolation tool.

16. A wellhead assembly as recited in claim 15 further comprising a seal interposed proximate a lower end of said wellhead isolation tool between said wellhead isolation tool and said second tubular member.

17. A wellhead assembly as recited in claim 15 further comprising a third flange extending from the wellhead isolation tool from a location above the second flange.

18. A wellhead assembly as recited in claim 15 wherein the wellhead isolation tool comprises a top end over a bottom end, wherein said top end extends above said second tubular member and wherein said second flange does not extend to said top end.

19. A wellhead assembly comprising:

a first tubular member;

a second tubular member over the first tubular member;

a first flange extending from the second tubular member;

a generally elongate annular member hanging in said second tubular member, said generally elongate annular member having a first portion extending above the second tubular member and a second portion below the first portion;

a second flange extending from the generally elongate annular member, wherein said second flange is fastened to said first flange, and wherein an axial load acting on said generally elongate annular member will be reacted in both the first and second flanges;

a member coupled to one of said flanges and to the generally elongate annular member for restraining axial movement of the generally elongate annular member relative to said one of said flanges;

another member coupled to the other flange of said flanges and to the generally elongate annular member for restraining axial movement of the generally elongate annular member relative to said other flange of said flanges; and a production tubing axially aligned with the generally elongate annular member.

20. The wellhead assembly as recited in claim 19 further comprising a fastener fastening the first flange to the second flange.

21. The wellhead assembly as recited in claim 19 wherein said second flange is separate from said generally elongate annular member.

22. The wellhead assembly as recited in claim 19 wherein said second tubular member comprises an inner surface and wherein said generally elongate annular member is suspended by said second tubular member inner surface.

23. The wellhead assembly as recited in claim 19 wherein the generally elongate annular member is a wellhead isolation tool.

24. The wellhead assembly as recited in claim 23 further comprising a fastener fastening the first flange to the second flange.

25. The wellhead assembly as recited in claim 23 wherein said second flange is separate from said generally elongate annular member.

26. The wellhead assembly as recited in claim 23 wherein said second tubular member comprises an inner surface and wherein said wellhead isolation tool is suspended by said second tubular member inner surface.

27. A wellhead assembly comprising:

a casing;

a first tubular member over the casing comprising an inner lip portion;

a first tubular member flange extending from the first tubular member;

a generally elongate annular member hanging in the first tubular member, said annular member having a first end portion extending above the first tubular member and a second end portion below the first end portion;

a second flange extending from the elongate annular member;

a fastener fastening the second flange to the first tubular member flange; and a production tubular member aligned with the elongate annular member, wherein the inner lip portion extends between the generally elongate annular member and the production tubular member, wherein an axial force acting on the generally elongate annular member will be reacted in both the first tubular member flange and the second flange, and wherein the elongate annular member comprises an inner diameter, wherein the lip portion comprises an inner diameter and wherein the production tubing comprises an inner diameter wherein the inner diameter of said elongate annular member, lip portion and production tubing are equal.

28. A wellhead assembly comprising:

a casing;

a first tubular member over the casing comprising an inner lip portion;

a first tubular member flange extending from the first tubular member;

a generally elongate annular member hanging in the first tubular member, said annular member having a first end portion extending above the first tubular member and a second end portion below the first end portion;

a second flange extending from the elongate annular member;

a member coupled to the second flange and engaging the generally elongate annular member, said member retaining said generally elongate annular member in an axial direction;

a fastener fastening the second flange to the first tubular member flange; and a production tubular member aligned with the elongate annular member, wherein the inner lip portion extends between the generally elongate annular member and the production tubular member, wherein an axial force acting on the generally elongate annular member will be reacted in both the first tubular member flange and the second flange.

29. A wellhead assembly as recited in claim 28 further comprising another member coupled to the first tubular member flange and engaging the generally elongate annular member, said another member retaining said generally elongate annular member in an axial direction.

30. A wellhead assembly comprising:

a casing;

a first tubular member over the casing comprising an inner lip portion;

a first tubular member flange extending from the first tubular member;

a generally elongate annular member hanging in the first tubular member, said annular member having a first end portion extending above the first tubular member and a second end portion below the first end portion;

a second flange extending from the elongate annular member, said second flange being separate from said generally elongate annular member, and wherein said second flange is threaded onto said generally elongate annular member;

a fastener fastening the second flange to the first tubular member flange;

a member coupled to one of said flanges and engaging the generally elongate annular member, said member retaining said generally elongate annular member in an axial direction; and a production tubular member aligned with the elongate annular member, wherein an axial force acting on the generally elongate annular member will be reacted in both the first tubular member flange and the second flange.

31. A wellhead assembly as recited in claim 30 wherein said member is coupled to said first tubular member flange.

* * * * *